US006415469B1

(12) United States Patent
Diaz Fernandez et al.

(10) Patent No.: US 6,415,469 B1
(45) Date of Patent: Jul. 9, 2002

(54) CONTROL SYSTEM AND PROCESS FOR AUTOMATICALLY CONTROLLING AGITATOR MOTION PATTERNS IN A WASHING MACHINE

(75) Inventors: Alfredo Diaz Fernandez, Santiago de Queretaro; Pedro Roberto Reyes Turrubiarte, Pachuca de Soto; Erick Flores Islas, Villa Corregidora; Juan Carlos Gonzalez Garcia Ancira, Santiago, all of (MX)

(73) Assignee: Mabe Mexico S. de R.L. de C.V. (MX)

( * ) Notice: Subject to any disclaimer, the term of this patent is extended or adjusted under 35 U.S.C. 154(b) by 171 days.

(21) Appl. No.: 09/583,858

(22) Filed: May 31, 2000

Related U.S. Application Data

(60) Provisional application No. 60/173,774, filed on Dec. 30, 1999.

(51) Int. Cl.[7] ..... D06F 33/02

(52) U.S. Cl. ..... 8/158; 8/159; 68/12.02

(58) Field of Search ..... 8/158, 159; 68/12.01, 68/12.02

(56) References Cited

U.S. PATENT DOCUMENTS

| | | | | |
|---|---|---|---|---|
| 4,255,952 A | | 3/1981 | Johnson | |
| 4,335,592 A | | 6/1982 | Torita | |
| 4,542,633 A | | 9/1985 | Hirooka et al. | |
| 4,554,805 A | | 11/1985 | Hirooka et al. | |
| 4,779,431 A | | 10/1988 | Burk et al. | |
| 4,910,979 A | | 3/1990 | Burk et al. | |
| 4,950,969 A | | 8/1990 | Getz | |
| 4,972,134 A | | 11/1990 | Getz et al. | |
| 5,038,091 A | | 8/1991 | Bashark | |
| 5,075,613 A | | 12/1991 | Fisher | |
| 5,130,624 A | | 7/1992 | Bashark | |
| 5,166,568 A | | 11/1992 | Nystuen et al. | |
| 5,172,573 A | | 12/1992 | Sharp et al. | |
| 5,200,684 A | | 4/1993 | Fisher et al. | |
| 5,220,814 A | * | 6/1993 | Imai et al. | 68/12.02 |
| 5,237,256 A | | 8/1993 | Bashark | |
| 5,297,403 A | | 3/1994 | Farrington et al. | |
| 6,041,625 A | * | 3/2000 | Nagai et al. | 68/12.02 |

* cited by examiner

*Primary Examiner*—Philip Coe
(74) *Attorney, Agent, or Firm*—Enrique J. Mora, Esq.; Beusse, Brownlee, Bowdoin & Wolter P.A.

(57) ABSTRACT

A process and system for controlling respective agitator motion patterns in a washing machine having a motor drive coupled to energize a motor that drives the agitator is provided. The process allows for selecting a desired agitator motion pattern based on one or more pattern selection signals. The process further allows measuring one or more parameters indicative of the actual agitator motion pattern. A comparing step allows for comparing the actual agitator motion pattern against the desired agitator motion pattern, and an adjusting step allows for adjusting one or more control signals supplied to the motor drive for correcting deviations between the actual agitator motion pattern and the desired motion pattern.

137 Claims, 18 Drawing Sheets

| |
|---|
| FIG. 7A |
| FIG. 7B |
| FIG. 7C |
| FIG. 7D |

| |
|---|
| FIG. 8A |
| FIG. 8B |
| FIG. 8C |
| FIG. 8D |

| |
|---|
| FIG. 10A |
| FIG. 10B |
| FIG. 10C |

CONTROL SYSTEM AND PROCESS FOR AUTOMATICALLY CONTROLLING AGITATOR MOTION PATTERNS IN A WASHING MACHINE

This application claims the benefit of U.S. Provisional Application No. 60/173,774, filed on Dec. 30, 1999

RELATED APPLICATIONS

This application is related to U.S. patent application Ser. No. 09/583466, entitled "Control System And Process For Automatically Controlling Water Level In A Washing Machine", by Alfredo Diaz Fernandez et al, filed concurrently with the present application, assigned to the same assignee of the present invention and herein incorporated by reference.

BACKGROUND OF THE INVENTION

The present invention is generally related to washing machines and, more particularly, to a process and system for selectively controlling agitator motion patterns, and water level in the washing machine.

Use of electronic controllers in washing machines have allowed to provide agitator control techniques that in varying degrees have partially addressed some relatively narrow needs. For example, U.S. Pat. No. 4,779,431 purports that an agitator drive that produces sinusoidal agitator motion in a washing machine, as opposed to square wave type of motion, results in somewhat improved wash action.

U.S. Pat. Nos. 4,542,633 and 4,554,805 disclose an agitator drive system that uses a rotational angle detector. Both of such patents appear to be limited to providing a fixed agitator stroke angle at a fixed rate of strokes/min, independently of the type of load or articles to be cleansed.

None of the foregoing controllers allow the washing machine for selectively controlling the agitator motion pattern so that the agitator motion pattern, e.g., angle of travel of the agitator and/or strokes/min of the agitator can be selectively adjusted to reflect a desired agitator motion pattern based on the specific characteristics of the articles to be cleansed, such as the type of fabric of the articles, the level of dirtiness of such articles, etc. In addition, none of the foregoing controllers, allow for implementing agitator control techniques by measuring predetermined inertial characteristics of the agitator that allow for selectively adjusting the water level of the washing machine based on the true needs of a given washing or rinsing cycle. In View of the above, it would be desirable to provide a control system and techniques for selectively controlling the agitator motion pattern based on the characteristics of the articles or load to be cleansed, as indicated by the user. It would also be desirable to adapt the same techniques to adjust the water level of the washing machine so that inexpensively and reliably the user of the washing machine is able to conserve a valuable natural resource, i.e., water, while at the same time ensuring that no fabric damage occurs due to inappropriate load density in a given washing cycle.

BRIEF SUMMARY OF THE INVENTION

Generally speaking, the present invention in one embodiment fulfills the foregoing needs by providing a process for controlling respective agitator motion patterns in a washing machine having a motor drive coupled to energize a motor that drives the agitator. The process allows for selecting a desired agitator motion pattern based on one or more pattern selection signals. The process further allows measuring one or more parameters indicative of the actual agitator motion pattern. A comparing step allows for comparing the actual agitator motion pattern against the desired agitator motion pattern, and an adjusting step allows for adjusting one or more control signals supplied to the motor drive for correcting deviations between the actual agitator motion pattern and the desired motion pattern.

The present invention in another embodiment further fulfills the foregoing needs by providing a control system for controlling respective agitator motion patterns in a washing machine having a motor drive coupled to energize a motor that drives the agitator. The system comprises a selecting module configured to select a desired agitator motion pattern based on one or more pattern selection signals. The system further comprises a measuring module configured to measure one or more parameters indicative of the actual agitator motion pattern and a comparing module configured to compare the actual agitator motion pattern against the desired agitator motion pattern. An adjusting module is configured to adjust one or more control signals supplied to the motor drive for correcting deviations between the actual agitator motion pattern and the desired motion pattern.

In yet another embodiment, the present invention fulfills the foregoing needs by providing a washing machine programmed for selectively controlling agitator motion patterns. The washing machine includes a motor that drives the agitator. The washing machine further includes a motor drive coupled to energize the motor, and a controller coupled to supply one or more control signals to the motor drive. The controller in turn comprises a selecting module configured to select a desired agitator motion pattern based on one or more pattern selection signals. The controller further comprises a measuring module configured to measure one or more parameters indicative of the actual agitator motion pattern, and a comparing module configured to compare the actual agitator motion pattern against the desired agitator motion pattern. An adjusting module is configured to adjust the one or more control signals supplied to the motor drive for correcting deviations between the actual agitator motion pattern and the desired motion pattern.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
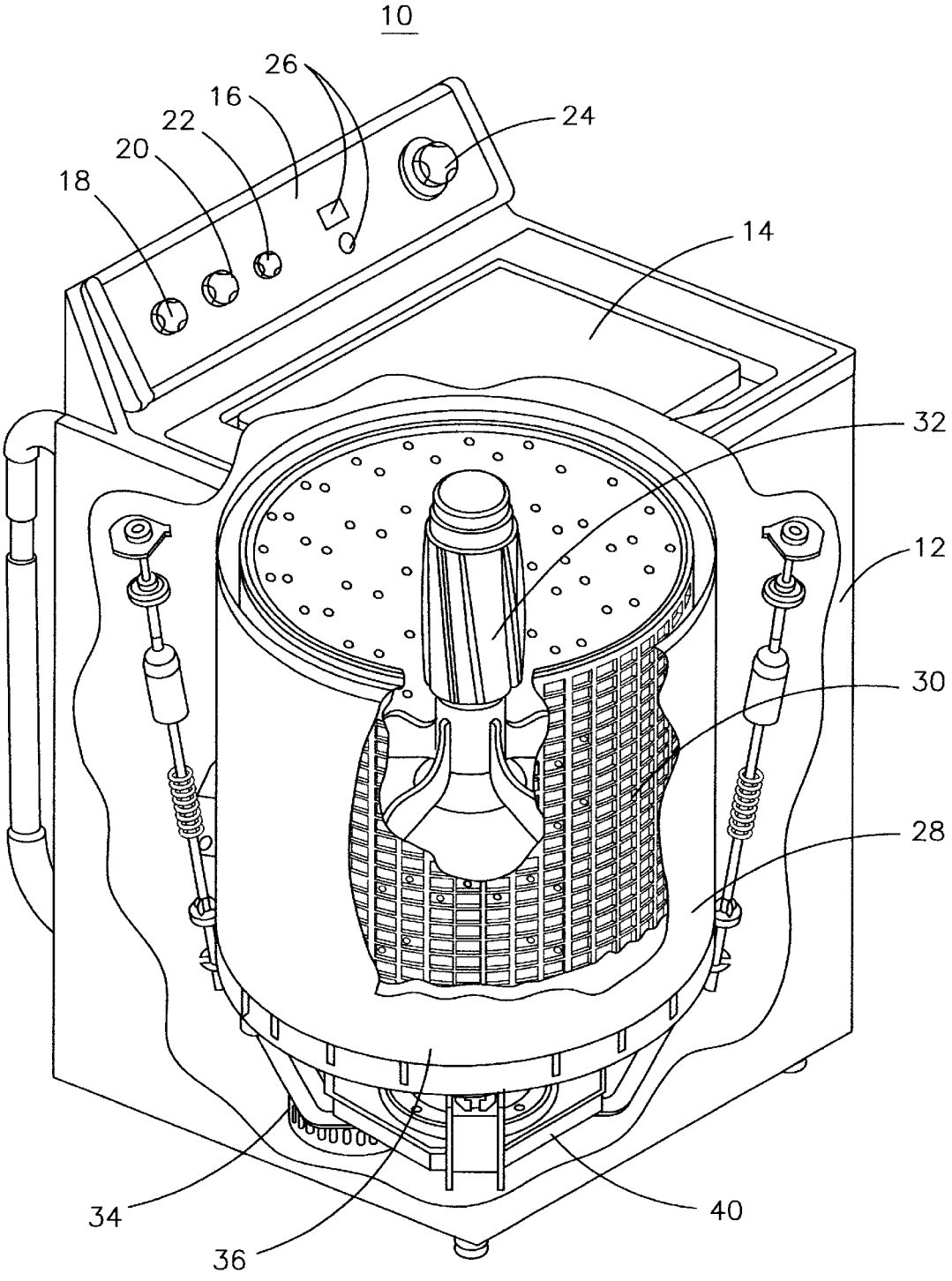
FIG. 1 is a perspective view partially cut away showing a washing machine using the present invention.

FIG. 1 illustrates an exemplary washing machine 10 that can readily benefit from the techniques of the present invention. It will be appreciated that the exemplary washing machine of FIG. 1 represents a vertical axis agitator type washing machine having pre-settable controls for automatically operating the machine through a programmed series of washing, rinsing, and spinning cycles.

The machine includes a cabinet 12 made up of respective panels forming the sides, top, front, and back of cabinet 12. A hinged lid 14 is provided in the usual manner for access to the interior of the washing machine 10. The washing machine 10 has a console 16 in which there are manually settable control means, including for example, a water level selector 18, a water temperature selector 20, a wash-intensity selector 22, and a type-of-fabric selector 24. Console 16 may further include suitable indicators 26, e.g., light emitting diodes, screen display, etc., that when lighted indicate to a user the present operational status of the machine, e.g., cycle status.

Internally of the washing machine 10 there is disposed a fluid-containing tub 28 within which is rotatably mounted a perforate basket 30 for rotation about the vertical axis. A vertically disposed agitator 32 is connected for operation to an electric motor 34 through a transmission assembly 36. The motor 34 and transmission assembly may be respectively mounted onto a platform 40 connected to the frame of the washer 10.

Figure 2:
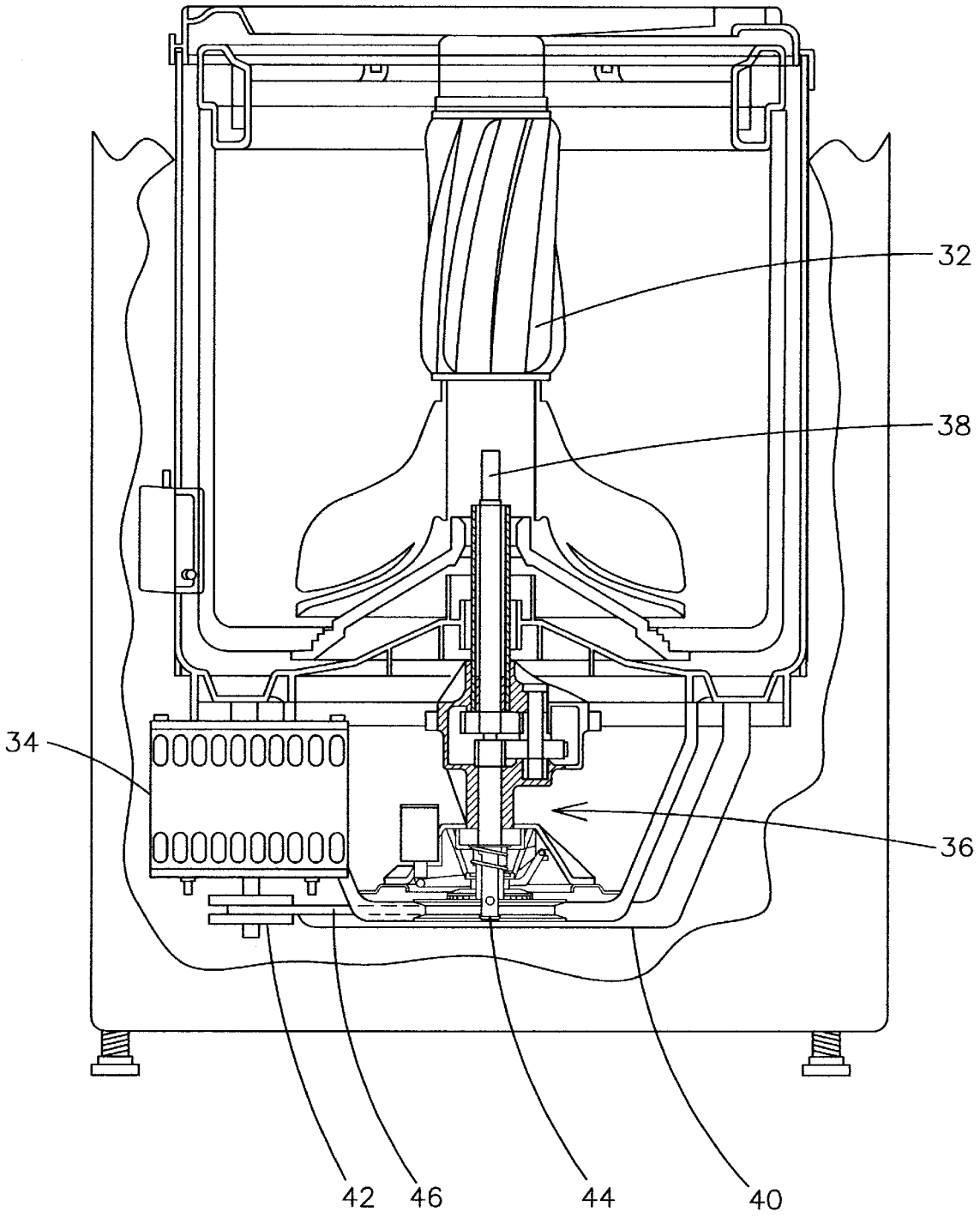
FIG. 2 is a front view partially cut away of the washing machine of FIG. 1.

Referring to FIG. 2, the agitator 32 is linked by a shaft 38 to the transmission assembly 36, which in turn is driven through a pulley arrangement by the motor 34 that may be a permanent split capacitor (PSC) motor. The motor 34 is linked to the transmission assembly 36 by the pulley arrangement that may include a driving pulley 42 and a driven pulley 44 connected by a belt 46. As is well-understood in the art, the transmission 36 may include a suitable reduction gear for transmitting relatively lower revolutions per minute (RPM) in an agitation cycle as compared to a spin cycle, and a coupler for mechanically coupling the basket and the tub to jointly receive unidirectional rotating power in the spin cycle, and decoupling the basket 30 from receiving rotating power in the agitation cycle while the agitator receives reciprocating rotating power. It will be appreciated that a variety of other reduction drive arrangements could be utilized as is known to those skilled in the art. It would be further appreciated that it would be realizable to eliminate the reduction drive and link the agitator directly to an appropriately selected motor. The shaft 38 extends upwardly from the transmission assembly 36 through the tub 28 and the perforate basket 30 and connects to the agitator 32.

Figure 3:
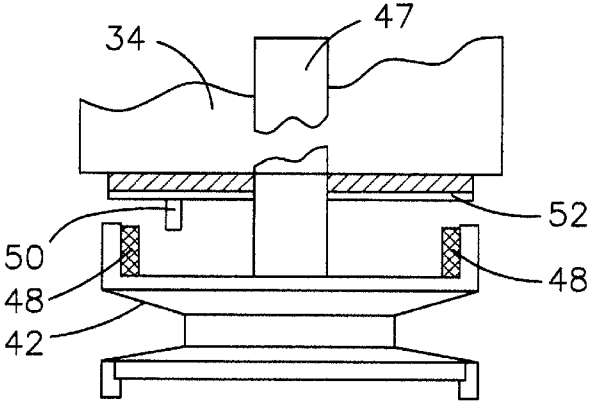
FIG. 3 is a fragmentary cross-sectional view illustrating an exemplary motion sensor.
Figure 4:
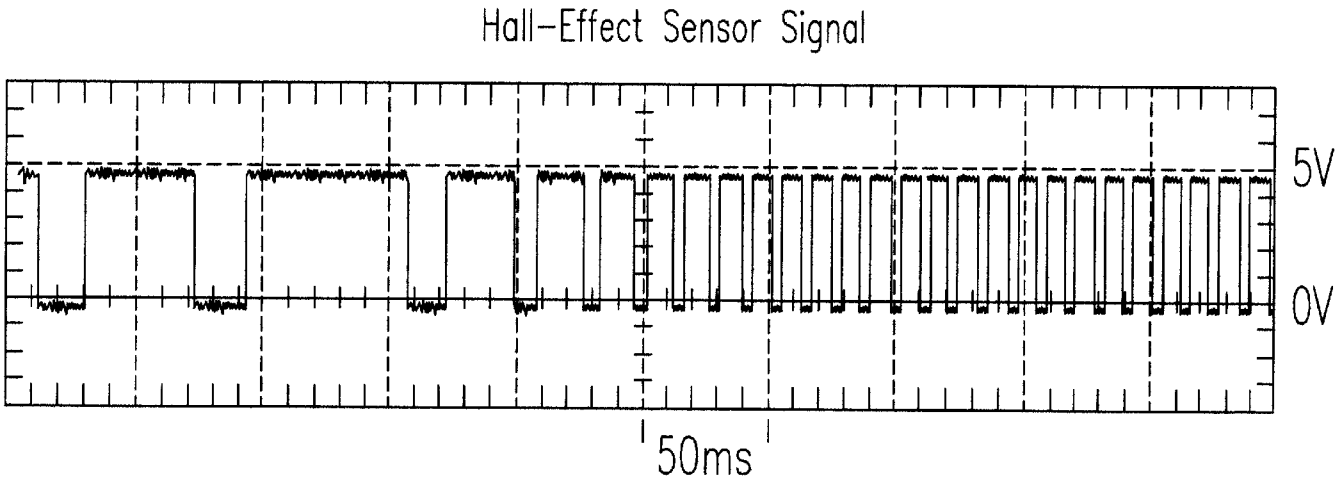
FIG. 4 is an exemplary waveform illustrating an output signal from the motion sensor of FIG. 3.

By way of example and not of limitation in order to measure agitator RPM and/or angular travel and as best shown in FIG. 3, driving pulley 42 coupled to a motor shaft 47 preferably includes a bipolar magnetic strip 48 that may include four or more changes of magnetic polarity for the purpose of establishing a magnetic field that is sensed by a Hall-effect sensor 50 mounted on printed circuit board 52, so that as driving pulley 42 is rotated and the sensor and the strip pass proximate to one another, the magnetic field created by magnetic strip 48 causes Hall-effect sensor 50 to supply a pulse output signal. Thus, in operation and as shown in FIG. 4, Hall-effect sensor 50 generates a stream of pulses indicative of the RPM and/or angular travel of the driving pulley 42. Since one can readily determine the gear ratio between the input and output of the transmission assembly, one can accumulate the stream of pulses over a known time interval to determine the RPM of the agitator over that time interval, and/or the basket when the basket is coupled to rotate. In addition, by tracking elapsed time for each stroke of the agitator, one can also determine the angular travel of the agitator, since the angular travel may be calculated by integrating the agitator RPM over the respective elapsed time. It will be appreciated by those skilled in the art, that the above arrangement for determining agitator RPM and/or angular travel is merely illustrative since other types of motion sensors, such as tachometers, optical sensors, etc., could be used in lieu of the Hall-effect sensor for measuring agitator RPM and/or angular travel. Also the specific location of the Hall-effect sensor need not be at the driving pulley since other locations, such as the driven pulley, could also be used.

Figure 5:
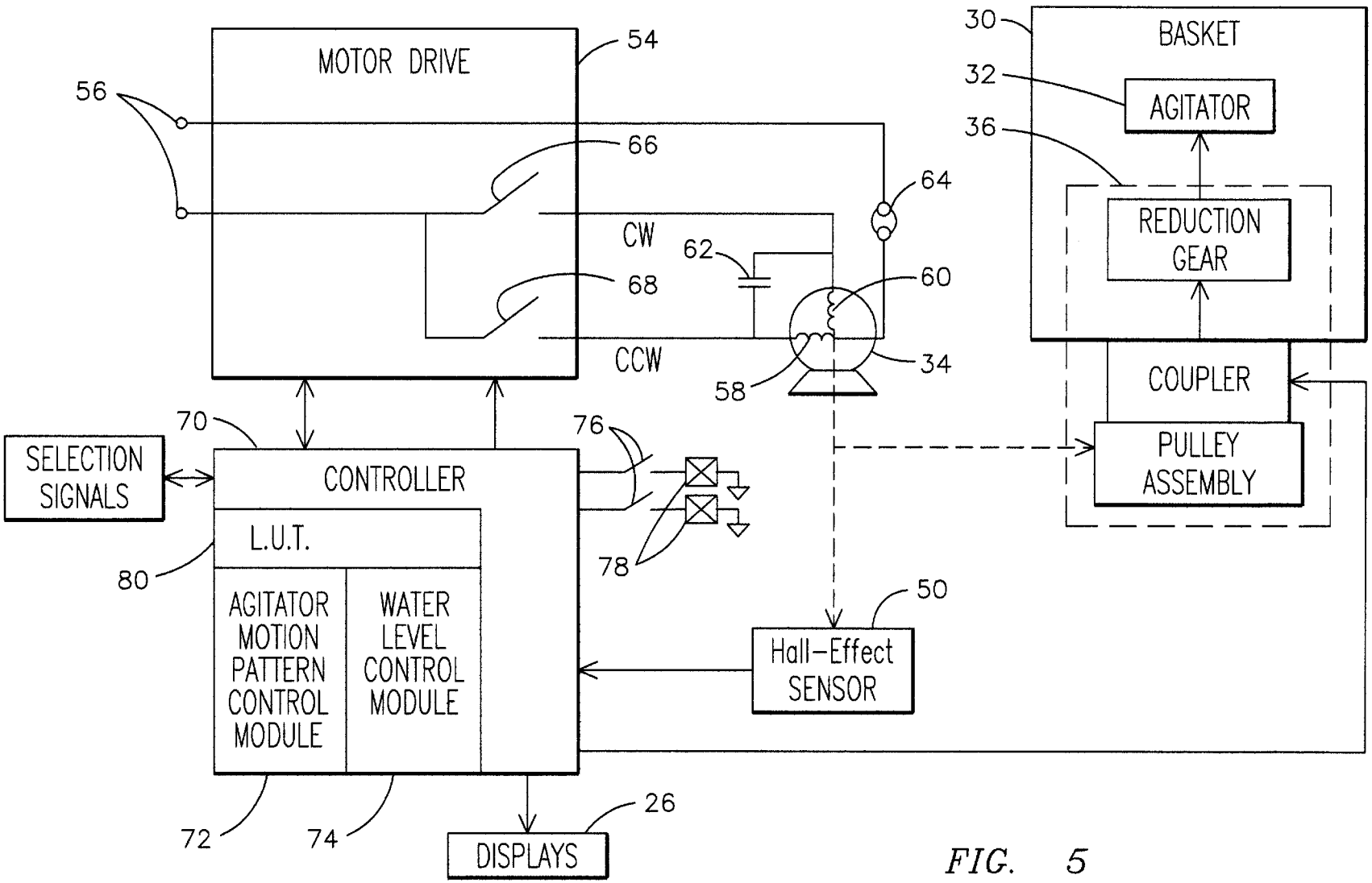
FIG. 5 is block diagram schematic of an exemplary washing machine control system embodying the present invention.

Referring now to FIG. 5, motor 34, e.g., a permanent split capacitor motor, is connected to a motor drive 54 that is connected to an alternating power source which supplies ac voltage and current to motor drive 54 via power terminals 56 at a suitable frequency and amplitude for operating the motor 34. The motor 34 includes a pair of windings 58 and 60 and a capacitor 62. A thermal protector 64 may be used for protecting windings 58 and 60 during electrical overload conditions. The windings are selectively connected such that one winding may be operated as a run winding and the other winding is operated as an auxiliary winding. A pair of power switches 66 and 68 are responsive to respective control signals supplied by a controller 70 to determine which of the windings 58 and 60 is to be the respective run and auxiliary windings so as to establish bidirectional or unidirectional rotation of the motor, depending on the cycle of operation of the washing machine. By way of example and not of limitation, switches 66 and 68 may comprise respective triacs, however, it will be appreciated that other types of bidirectional switching means could be used in place of switching triacs 66 and 68, such as mechanical switches or relays. However, the use of triacs allows relatively precise control of the instant at which the windings are selectively energized or deenergized. For readers who are interested in further background information regarding operation and control of permanent split capacitor motors, see pages 138–159 of textbook titled "Fractional and Subfractional Horsepower Electric Motors, $4^{th}$ Ed., by Cyril G. Veinott and Joseph E Martin, published by the McGraw-Hill Book Company. It will be appreciated that the present invention is not limited to washing machines using a permanent split capacitor motor, since washing machines using other types of AC induction motors or DC motors, such as brushless electronically-commutated motors, may also benefit from the techniques of the present invention.

Using the motor and switching arrangement of FIG. 5, a rapid reversal of the direction of rotation of motor 34 may be realized by respectively energizing the windings 58 and 60. As suggested above, control of the agitator motion pattern can now be attained by selectively energizing the motor 34 based on the RPM and/or angular travel of the agitator which in turn allows for controlling number of strokes per unit of time, e.g., strokes/min, and/or angle of travel of the agitator during each respective stroke. For example, an agitator motion pattern control module 72 allows for energizing the motor for executing a desired level of strokes/min and/or agitator travel upon start of a respective agitator stroke, deenergizing the motor until the agitator reaches a predetermined final velocity, and waiting or imparting a delay for a selected period of time, and then, upon termination of such delay, the motor 34 is reversed by changing the switching polarity of switches 66 and 68. Similarly, a water level control module 74 allows for controlling the water level of the washing machine based on comparing actual inertial characteristics of the agitator that in one exemplary embodiment can be measured with a timer, such as agitator stoppage time, against a predetermined target stoppage time that takes into account the specific characteristics of the load to be washed. As described below, water level control module 74 allows for generating respective actuating signals supplied to respective relays 76 to selective energize one or more water valves 78 to allow passage of water into the fluid-containing tub of the washing machine.

Figure 6:
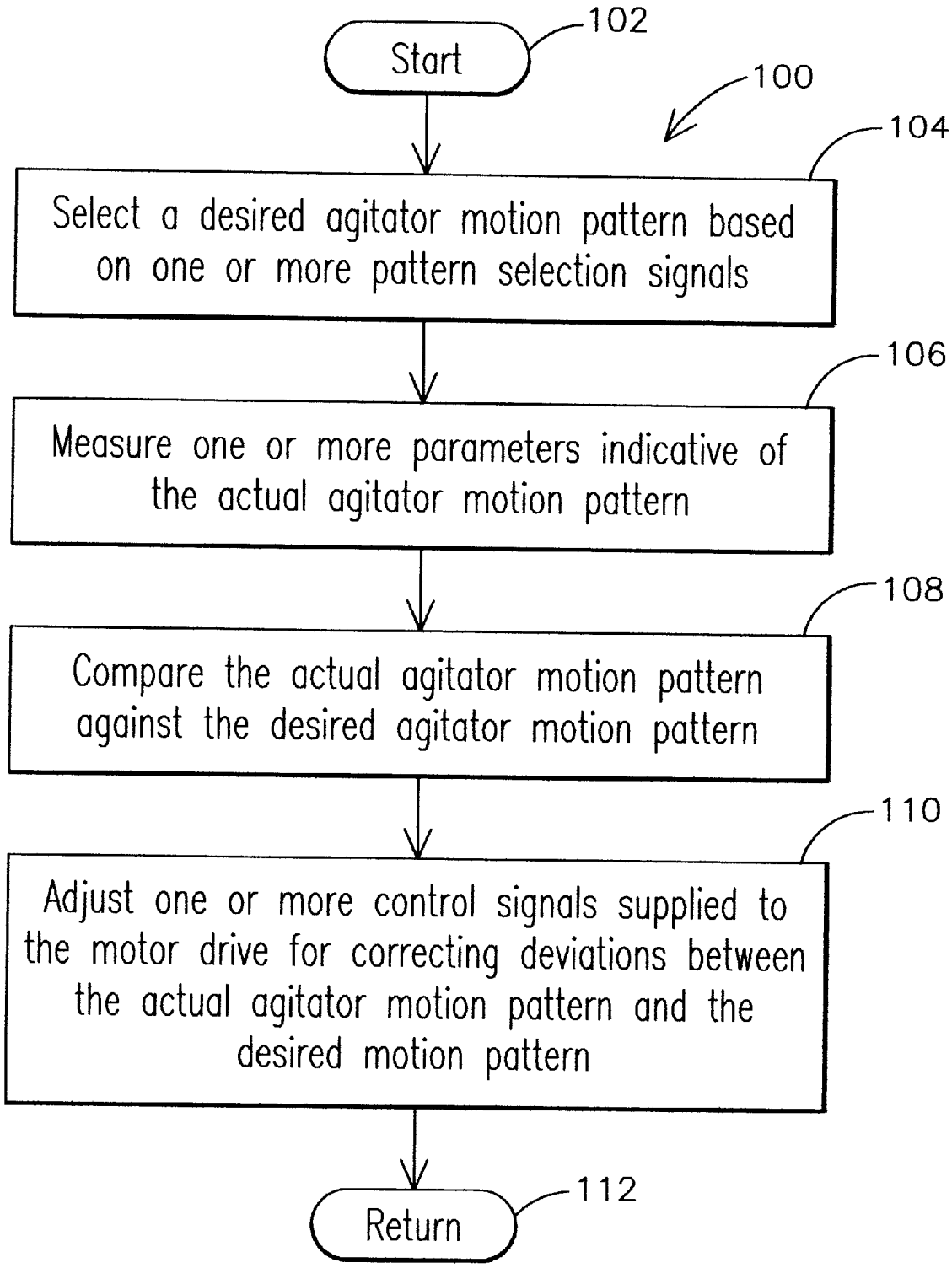
FIG. 6 is a flow chart of an exemplary process of the present invention for controlling agitator motion patterns as may be implemented by the control system of FIG. 5.

FIG. 6 is a flow chart of an exemplary process 100 of the present invention for controlling respective agitator motion patterns in a washing machine that has a motor drive 54 (FIG. 5) coupled to energize a motor 34 (FIG. 5) that drives the agitator of the washing machine. Subsequent to start step 102, step 104 allows for selecting a desired agitator motion pattern based on one or more pattern selection signals, such as may be inputted by the operator based on the type-of-fabric of the articles to be washed, desired wash intensity, etc. Step 106 allows for measuring one or more parameters indicative of the actual agitator motion pattern, such as agitator RPM, angular travel, etc. Step 108 allows for comparing the actual agitator motion pattern against the desired agitator motion pattern. For example, a look-up table (LUT) 80 (FIG. 5) or memory in controller 70 may be used for storing a predefined desired agitator motion pattern for a given type of fabric, so that when the user enters the type of fabric to be washed, the selection signals thus generated allow for automatically selecting from the LUT the respective desired agitator motion pattern that corresponds to that type of fabric. Prior to return step 112, step 110 allows for adjusting one or more control signals supplied to the motor drive for correcting deviations between the actual agitator motion pattern and the desired motion pattern. It will be appreciated that the operational and functional interrelationships, as described above in the context of FIG. 6 and further described below in the context of FIGS. 7 and 8, for controlling agitator motion patterns may be programmed into respective software modules that are stored to be executed by any suitable microprocessor in controller 70 (FIG. 5). It will be further appreciated that execution of such interrelationships for controlling agitator motion patterns need not be limited to software modules since, if optionally desired, hardware modules could be used, to implement the same functions.

Figures 7, 7A:
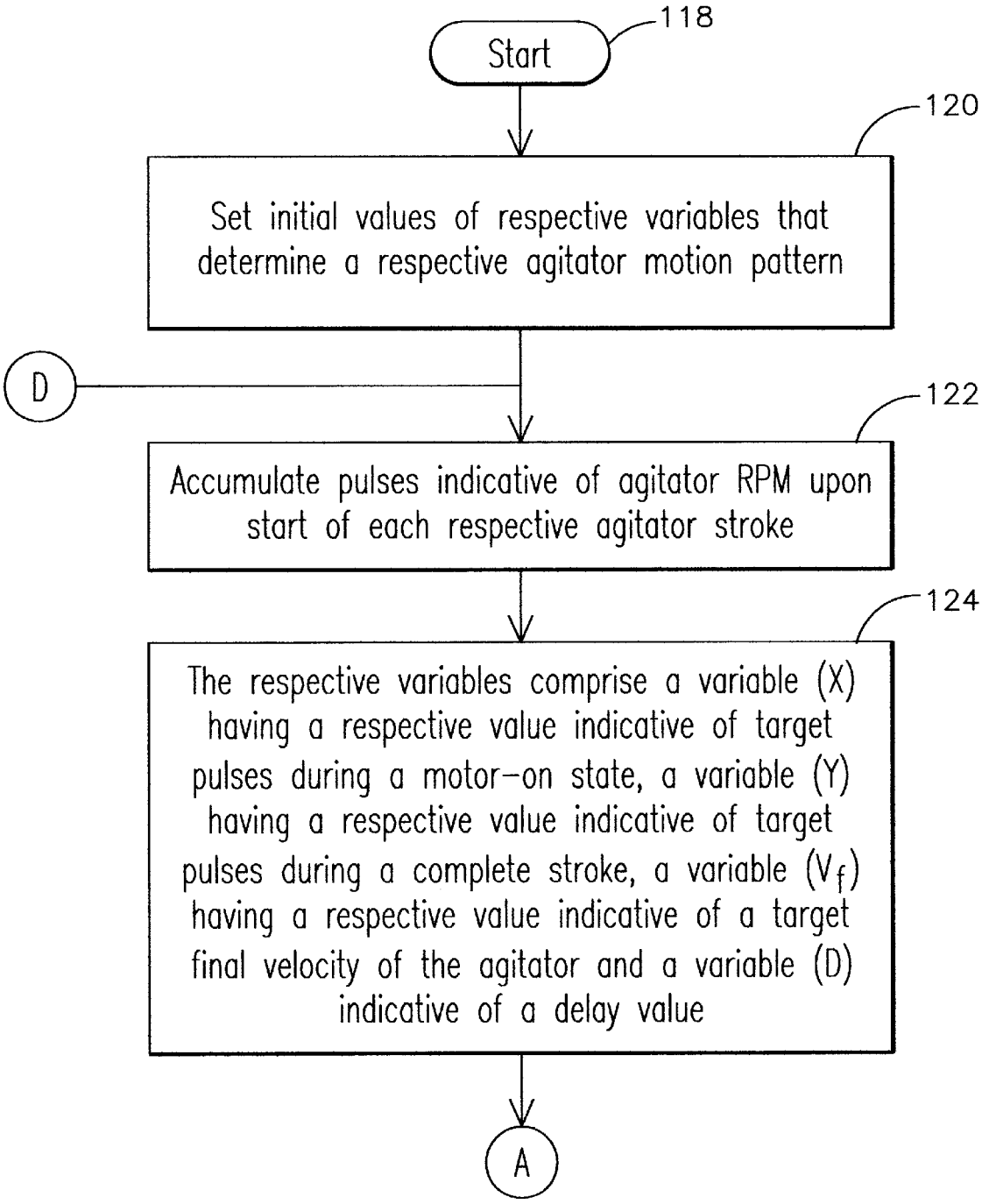
FIG. 7 is a flow chart of one exemplary embodiment of the process of FIG. 6.
Figure 7B:
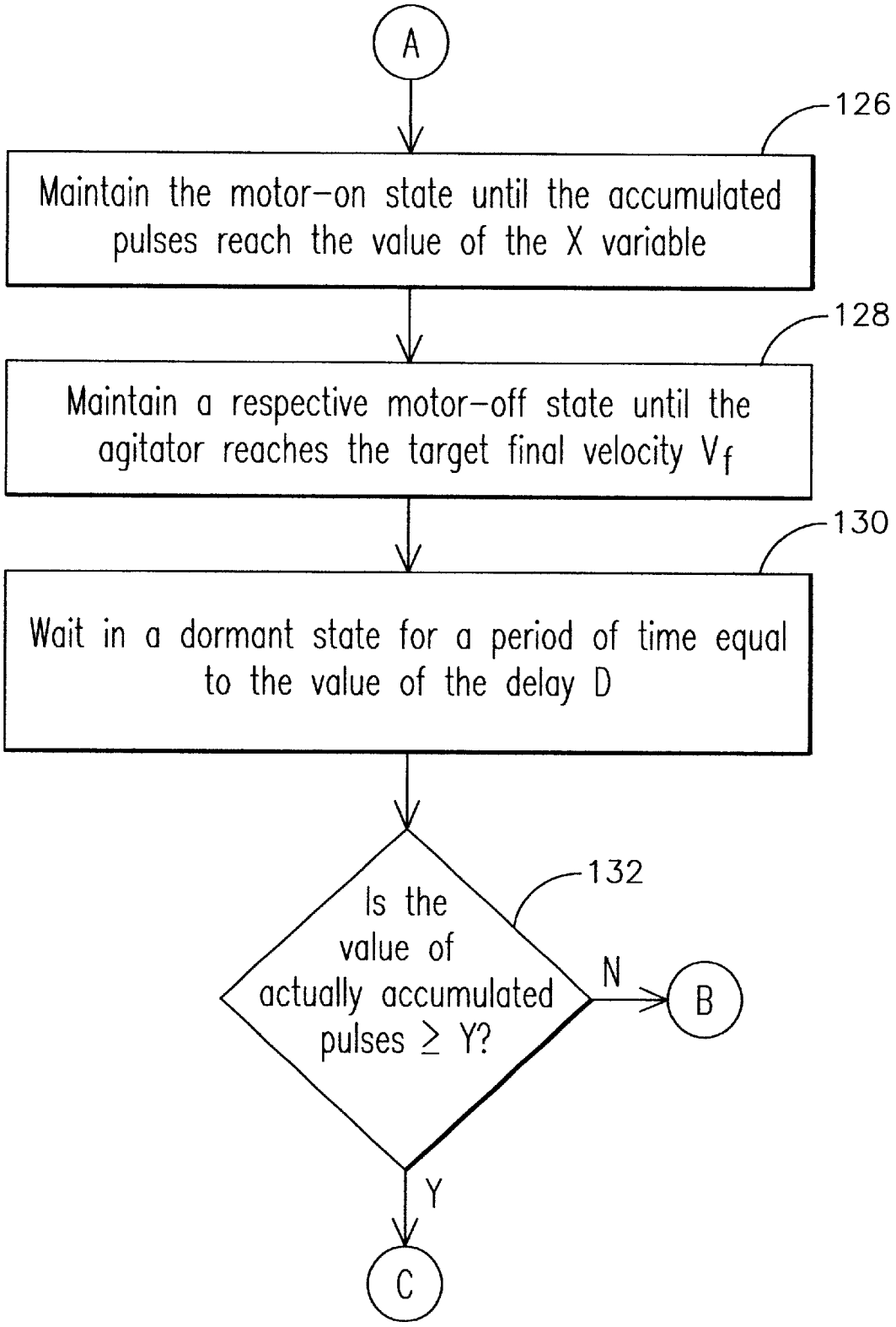
Figure 7C:
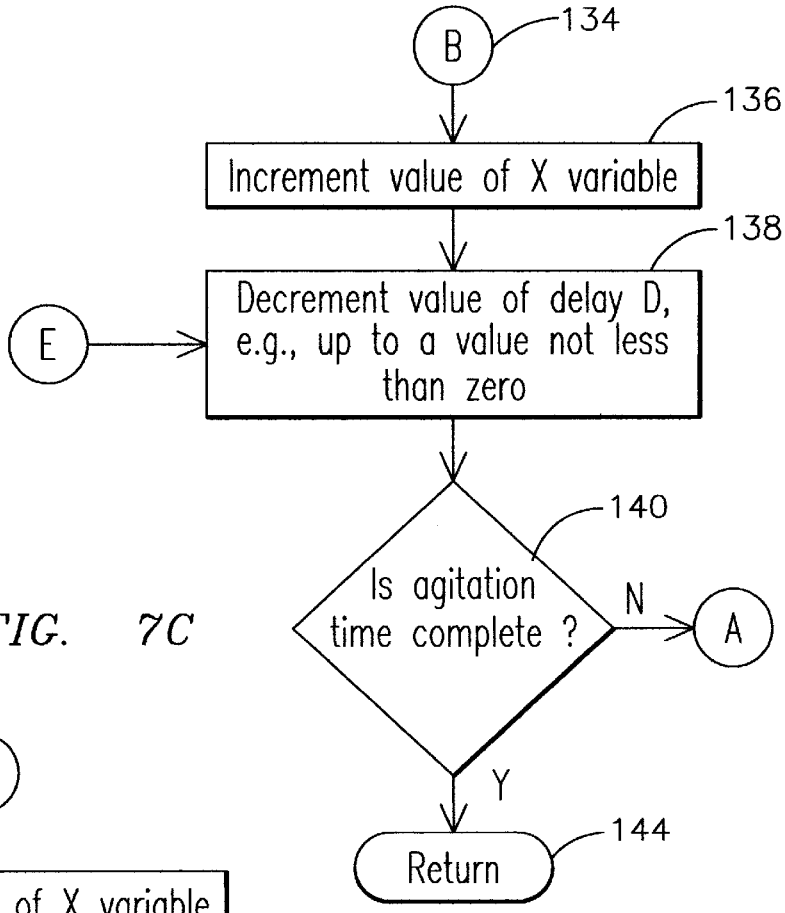
Figure 7D:
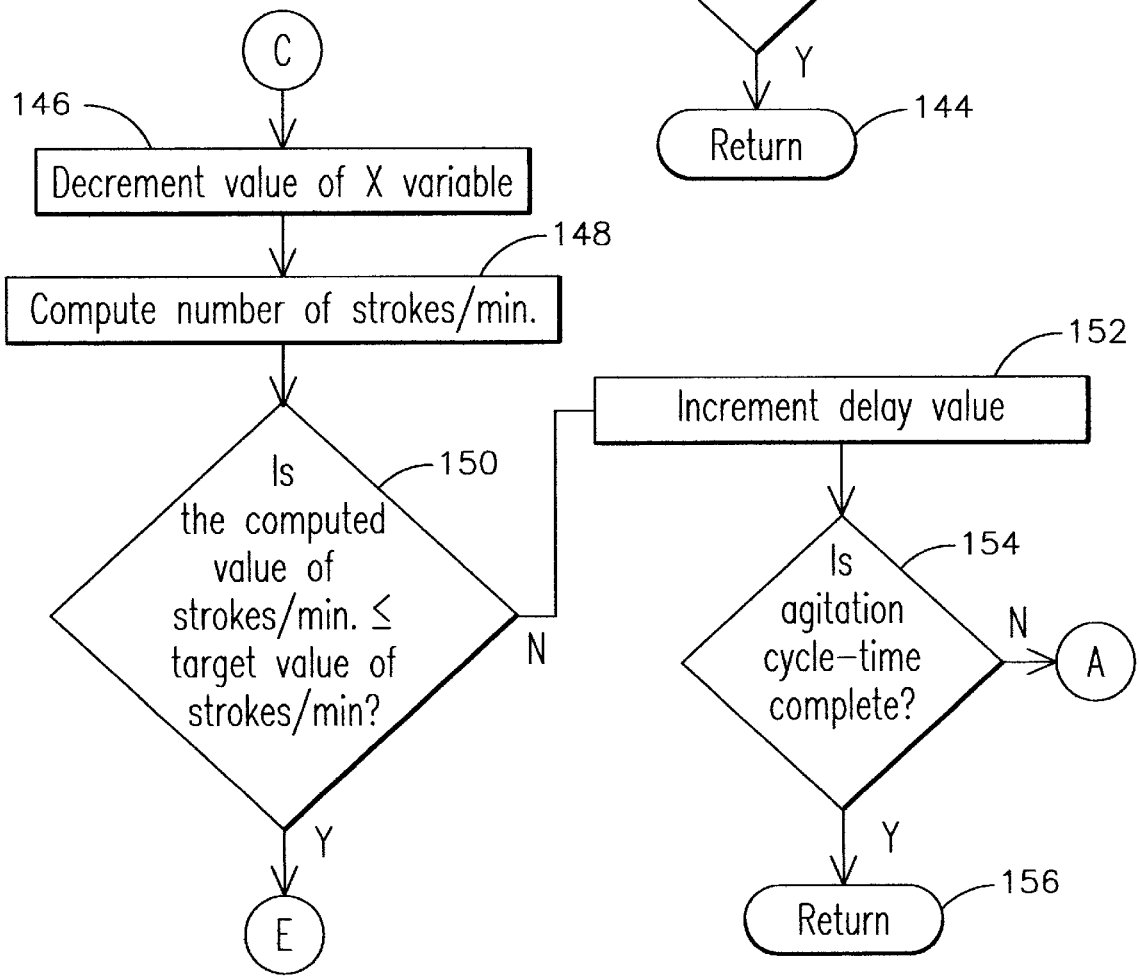

FIG. 7 is a flow chart of one exemplary embodiment of the process illustrated in FIG. 6 above. Subsequent to start step 118, step 120 allows for setting initial values of respective variables that determine a respective agitator motion pattern. Step 122 allows to accumulate pulses indicative of agitator RPM upon start of each respective agitator stroke, e.g., a stroke in the clockwise (CW) direction. As suggested above, the pulses are obtained from motion sensor 50 (FIG. 5) over a known period of time and may indicate agitator RPM, or could be mathematically integrated to indicate agitator travel per stroke. As shown in block 124, examples of the respective variables which are initialized at step 120 may comprise a variable (X) having a respective value indicative of target pulses during a motor-on state. A variable (Y) having a respective value indicative of target pulses during a complete stroke, a variable ($V_f$) having a respective value indicative of a target final velocity of the agitator and a variable (D) indicative of a delay value. Step 126 reached through connecting node A allows for maintaining the motor-on state until the accumulated pulses reach the value of the X variable. Step 128 allows for maintaining a respective motor-off state until the agitator reaches the target final velocity $V_f$. Step 130 allows for waiting in a dormant state for a period of time equal to the value of the delay (D). Step 132 allows for comparing the number of pulses actually accumulated during a complete agitator stroke against the value of the Y variable.

It will be appreciated that the foregoing step and subsequent delay adjusting steps described respectively allow for controlling first the angular travel per stroke of the agitator, and then controlling the number of strokes/min. In particular, step 136, reached through connecting node B, allows for incrementing the value of the X variable depending on whether the value of the pulses actually accumulated during the complete agitator stroke is below the value of the Y variable. Step 138 allows for decrementing the value of the delay variable D by a predetermined amount. It will be appreciated that delay variable D is only permitted to assume positive values so delay variable D is not decremented below a zero value. Step 140 allows for determining whether the agitation cycle time is complete or not. If the agitation time is complete, then the process proceeds to return step 144. Conversely, if the agitation time is not complete, then connecting node A allows for iteratively executing the step for adjusting the one or more control signals supplied to the motor drive using the adjusted values of the respective variables X, Y and D for each respective successive reciprocating stroke of the agitator at least until the agitation cycle time of the washing machine is completed.

Returning to step 132, it can be seen that if the value of the accumulated pulses is larger or equal than the Y variable, then connecting node C allows for continuing at step 146 which in turn allows for decrementing the value of the X variable. Step 148 allows for computing the number of strokes per minute. It will be appreciated that the number of strokes per minute may be computed by taking the inverse of time elapsed upon start of the respective stroke. Thus, it will be appreciated that controller 70 (FIG. 5) includes a standard timer circuit for accurately keeping track of time as the process 100 is executed and, more particularly, as each agitator stroke is executed. Step 150 allows for comparing the computed value of number of strokes per unit of time against a target value of strokes per unit of time. As suggested above, for example, the target value of strokes/min may be selected based on the type of the fabric to be washed. For example, for rugged fabrics, the target strokes/min may be relatively higher than for delicate fabrics. If the computed value of strokes per unit of time is below or at the target value of strokes per unit of time, then connecting node E connects to decrementing step 138 as described above. Conversely, if the computed value of strokes per unit of time exceeds the target value of strokes per minute, then step 152 allows for incrementing the delay variable D by a predetermined amount. As suggested above, step 154 allows for determining whether the agitation cycle time is complete or not. If the agitation cycle time is complete, then the process proceeds to return step 156. If the agitation cycle time is not complete, then connecting node A once again allows for iteratively executing the step for adjusting the one or more control signals supplied to the motor drive using the adjusted values of the respective variables X, Y and D for each respective successive reciprocating stroke of the agitator until the agitation cycle time of the washing machine is complete.

Figures 8, 8A:
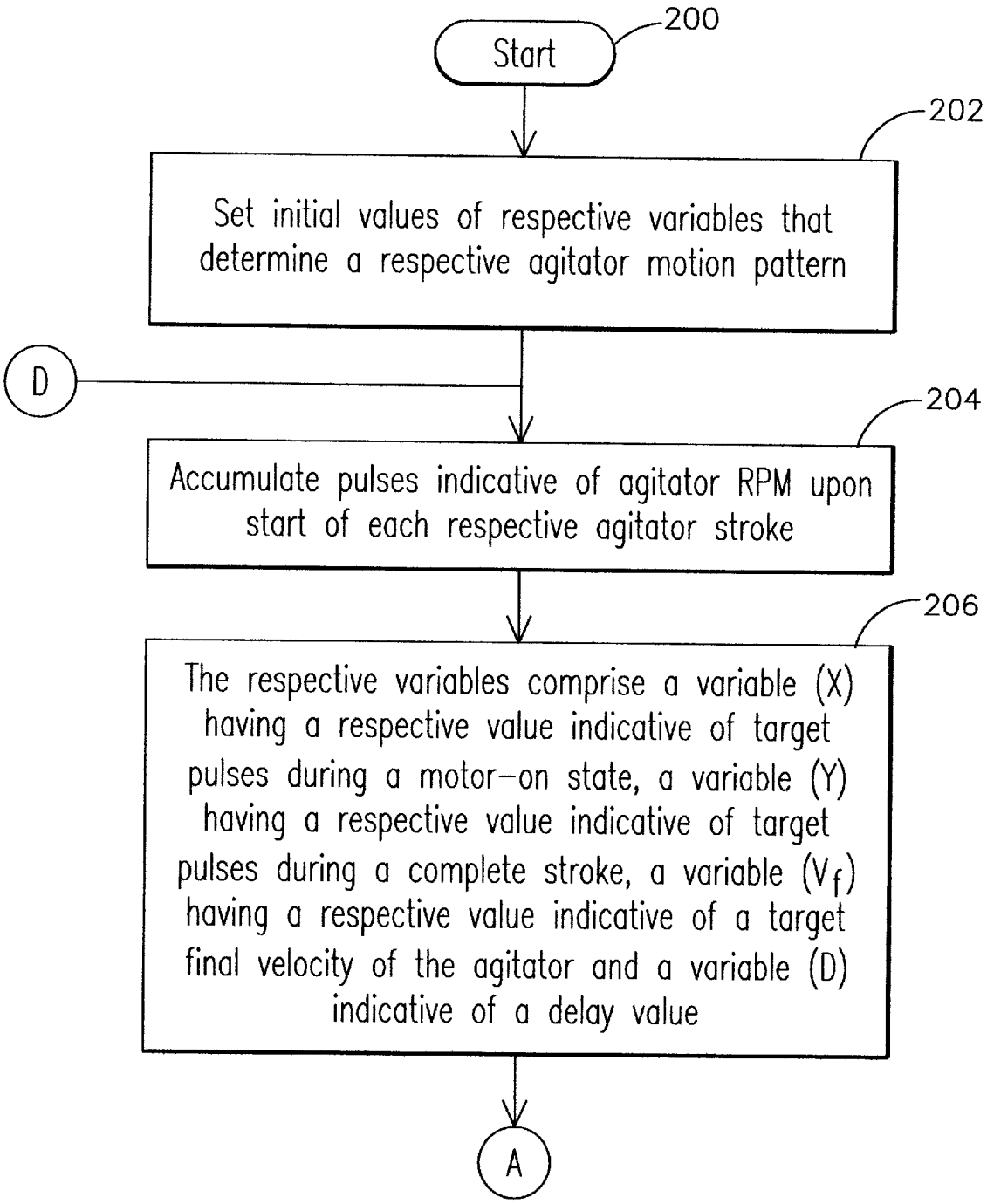
FIG. 8 is a flow chart of another exemplary embodiment of the process of FIG. 6.
Figure 8B:
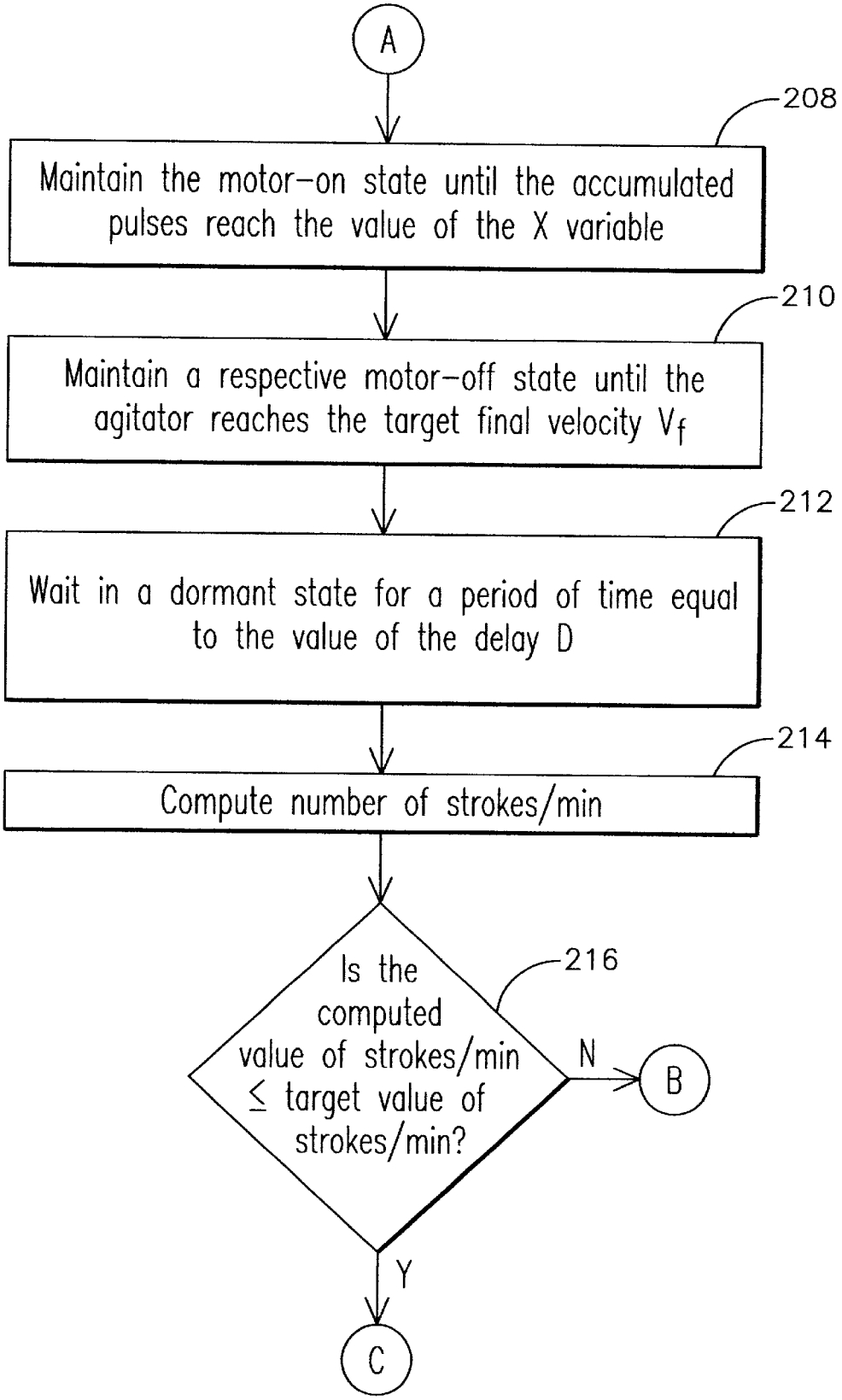
Figure 8C:
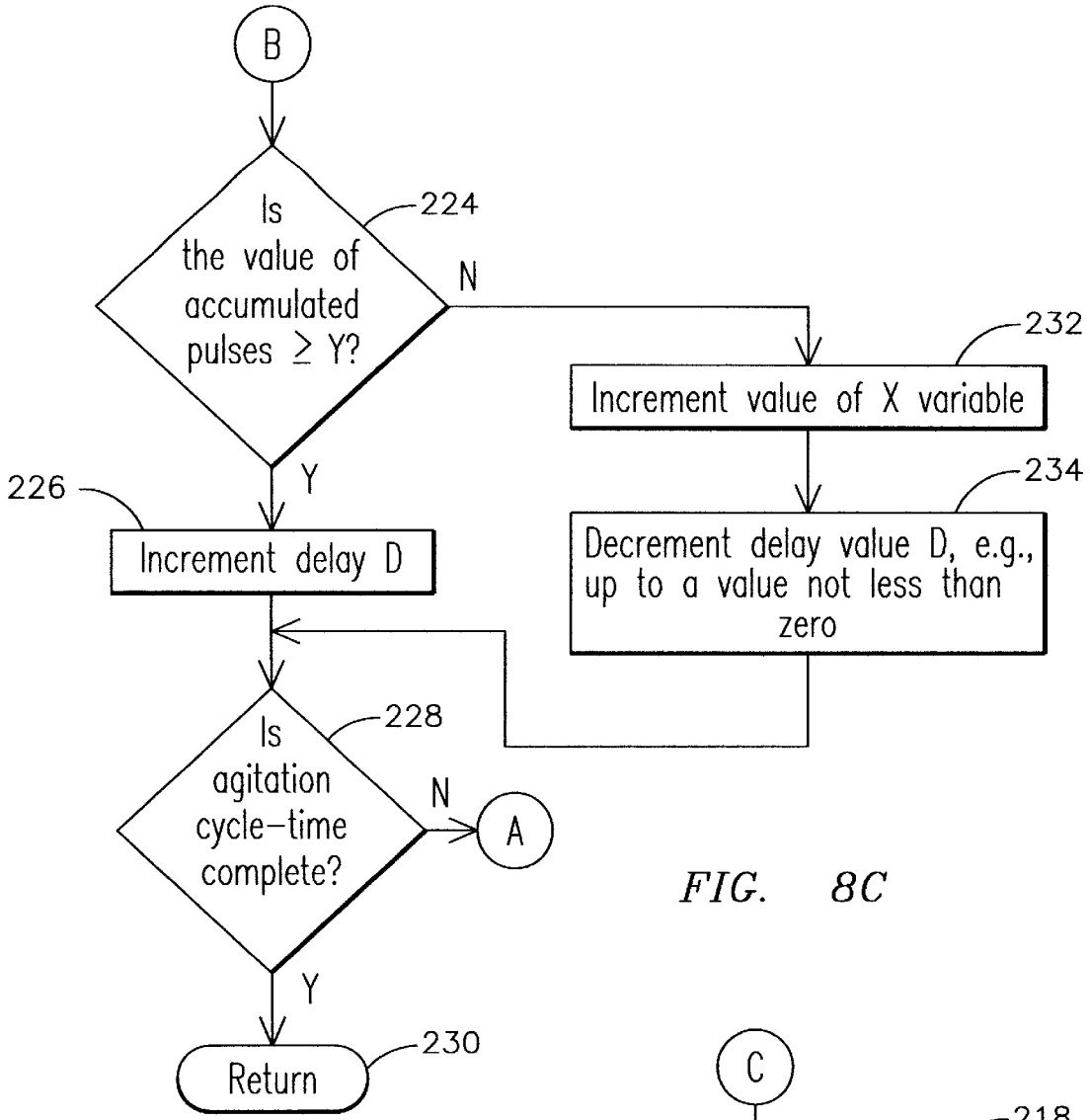
Figure 8D:
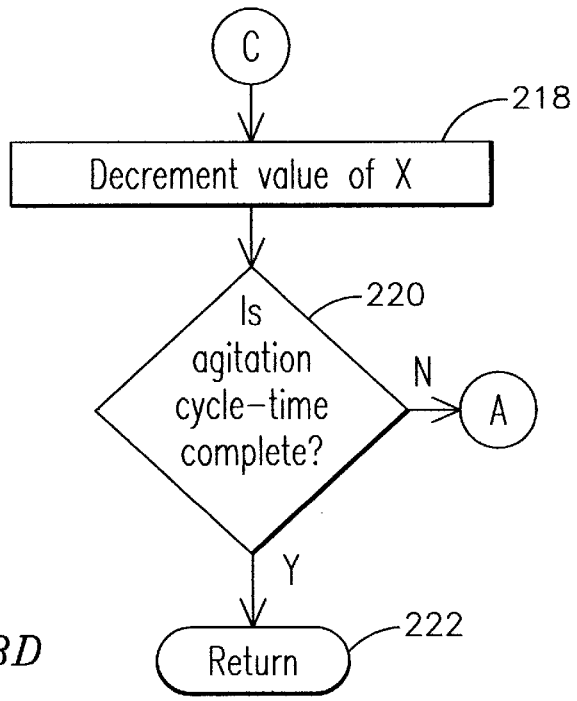

FIG. 8 is a flow chart of another exemplary embodiment of the process 100 of the present invention. Subsequent to start step 200, step 202 allows for setting the initial values of the respective variables that determine a respective agitator motion pattern. Step 204 allows for accumulating pulses indicative of agitator RPM and/or agitator travel upon start of each respective agitator stroke. Block 206 illustrates some of the respective variables that may be initialized at step 202. As suggested above, examples of such variables include a variable (X) having a respective value indicative of target pulses during a motor-on state, a variable (Y) having a respective value indicative of target pulses during a complete stroke, a variable ($V_f$) having a respective value indicative of a target final velocity of the agitator and a variable (D) indicative of a delay value. Step 208 reached through connecting node A allows for maintaining the motor-on state until the accumulated pulses reach the value of the X variable. Step 210 allows for maintaining a respective motor-off state until the agitator reaches the target final velocity $V_f$. Step 212 allows for waiting in a dormant state for a period of time equal to the value of the delay D.

In contrast to the embodiment of FIG. 7 that allows for initially adjusting angular travel of the agitator, and then adjusting strokes/min, the embodiment of FIG. 8, allows for initially adjusting strokes/min and then adjusting angular travel of the agitator. Accordingly, step 214 allows for computing number of strokes per unit of time. Step 216 allows for comparing the computed number of strokes per minute against a target value of strokes per minute. If the computed value of number of strokes per unit of time is equal or less than the target value of strokes per unit of time, then connecting node C proceeds to step 218 that allows for decrementing the value of variable X by a predetermined amount. Step 220 allows for determining whether agitation cycle time is complete or not. If the agitation cycle time is complete, then the process proceeds to return step 222. Conversely, if the agitation cycle time is not complete, connecting node A allows for iteratively executing the step for adjusting the one or more control signals supplied to the motor drive using the adjusted values of the respective variables X, Y and D for each respective successive reciprocating strokes (CW and CCW) of the agitator until the agitation cycle time is completed. If the computed value of strokes per minute is not larger or equal than the target value of strokes per minute, then connecting node B connects to step 224 which allows for comparing the value of accumulated pulses against the Y variable. If the value of the accumulated pulses is larger or equal than the value of the variable Y, then step 226 allows for incrementing the value of the delay variable D. Once again, step 228 allows for determining whether the agitation cycle time is complete or not. If the agitation cycle time is complete, then the process proceeds to return step 230. If the agitation cycle time is not complete, then the process proceeds through connecting node A to execute further iterations until the agitation cycle time is completed. If the value of the accumulated pulses is less than the value of the variable Y, then step 232 allows for incrementing the value of the X variable. Step 234 allows for decrementing the value of the delay variable D and further allows for proceeding to step 228 for determining whether the agitation cycle time is complete or not as suggested above.

Figure 9:
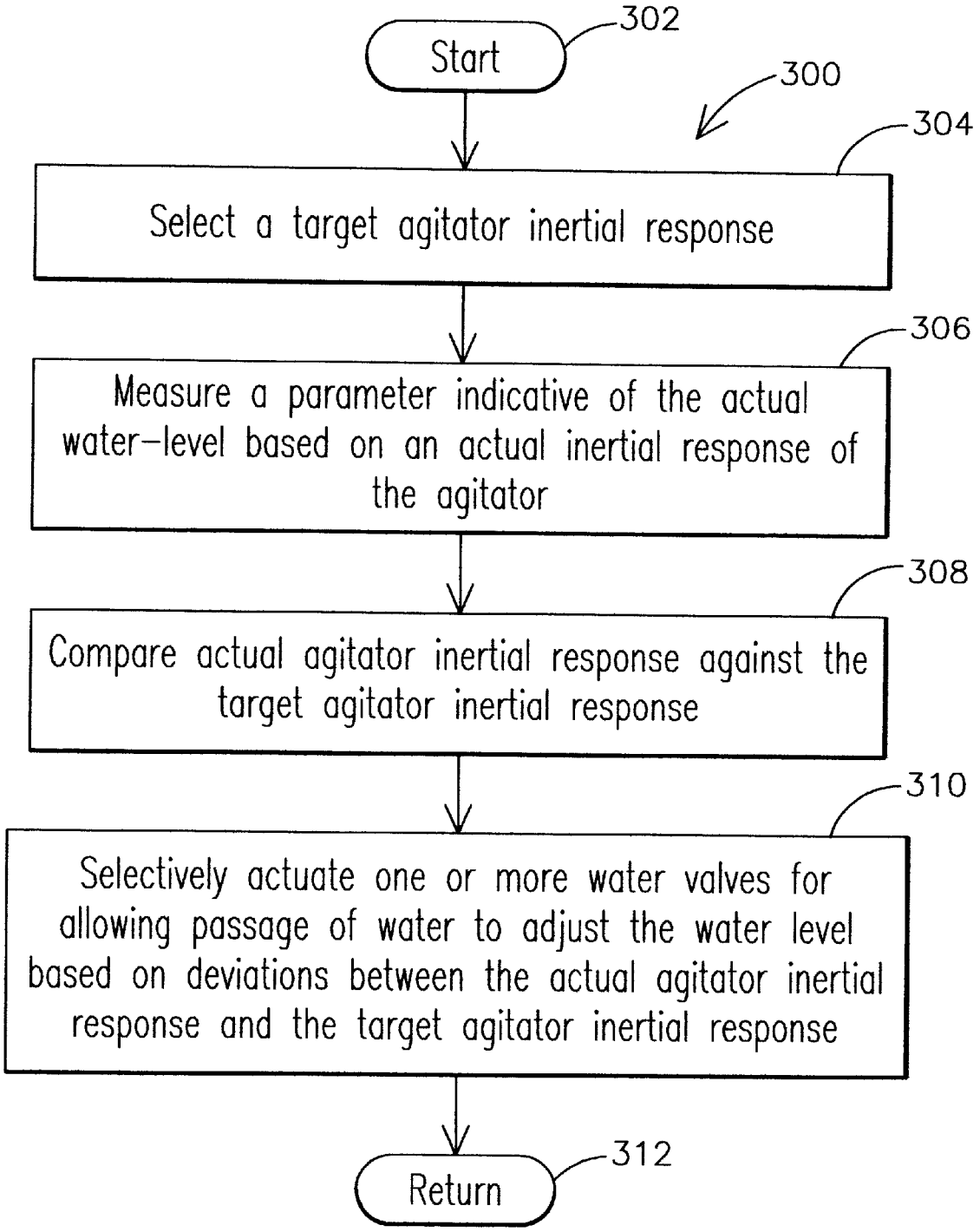
FIG. 9 is a flow chart of an exemplary process for controlling water level as may be implemented by the control system of FIG. 5.

FIG. 9 is a flow chart of an exemplary process 300 of the present invention for automatically controlling water-level in a washing machine having a motor drive coupled to energize a motor that drives the agitator. Subsequent to start step 302, step 304 allows for automatically selecting a target water level based on one or more water level selection signals. Step 306 allows for measuring a parameter indicative of the water level based on the actual inertial response of the agitator, such as the amount of time the agitator requires to reach a predetermined final velocity upon the motor being deenergized, hereinafter referred to a agitator stoppage time. It will be appreciated that agitator stoppage time depends on load density, e.g., pounds of clothes to be washed/per gallons of cleansing fluid. If the load is tight, such as may occur for a relatively high load density, then the agitator stoppage time will be relatively short. Conversely, if the load is loose, such as may occur for a relatively low load density, then the agitator stoppage time will be relatively longer to reach the predetermined final velocity. Step 308 allows for comparing the actual agitator inertial response against a target agitator inertial response. The target inertial response may be based on the particular characteristics of the load to be washed. For example, delicate fabrics may require to be washed less tightly relative to more rugged fabrics, and thus may require a higher water level as compared to a load of rugged fabrics having the same weight as the load of delicate fabrics. Prior to return step, 312, step 310 allows for selectively actuating one or more water valves, such as the hot and cold water valves, for allowing passage of water into the fluid-containing tub to adjust the water level based on deviations between the actual agitator inertial response and the target agitator inertial response. As suggested above, it will be appreciated that the operational and functional interrelationships, as described above in the context of FIG. 9 and further described below in the context of FIG. 10, for controlling water level may be programmed into respective software modules that are stored to be executed by any suitable microprocessor in controller 70 (FIG. 5). It will be further appreciated that execution of such interrelationships for controlling water level need not be limited to software modules since, if optionally desired, hardware modules could be used to implement the same functions.

Figures 10, 10A:
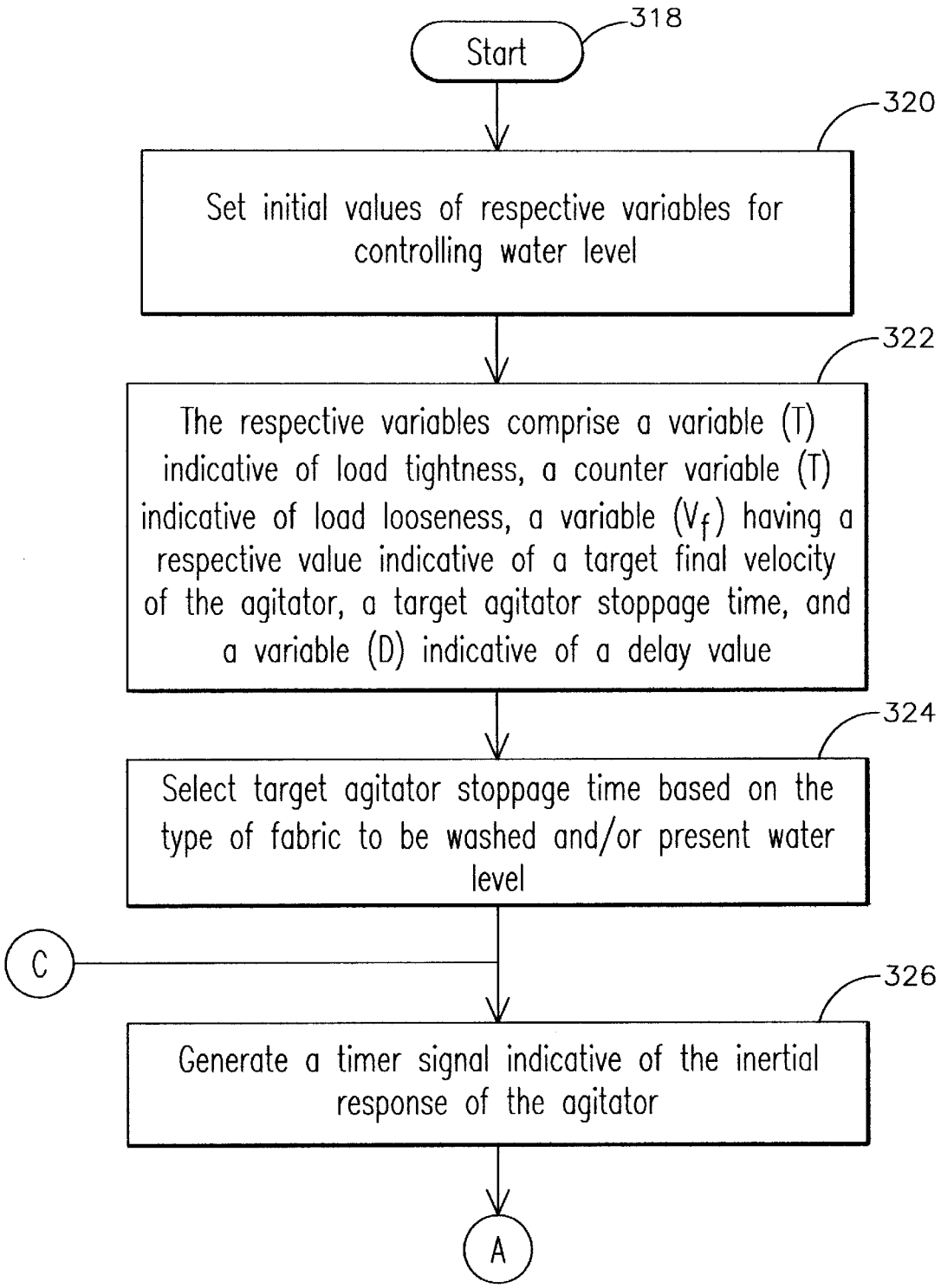
FIG. 10 is a flow chart of one exemplary embodiment of the process of FIG. 9.
Figure 10B:
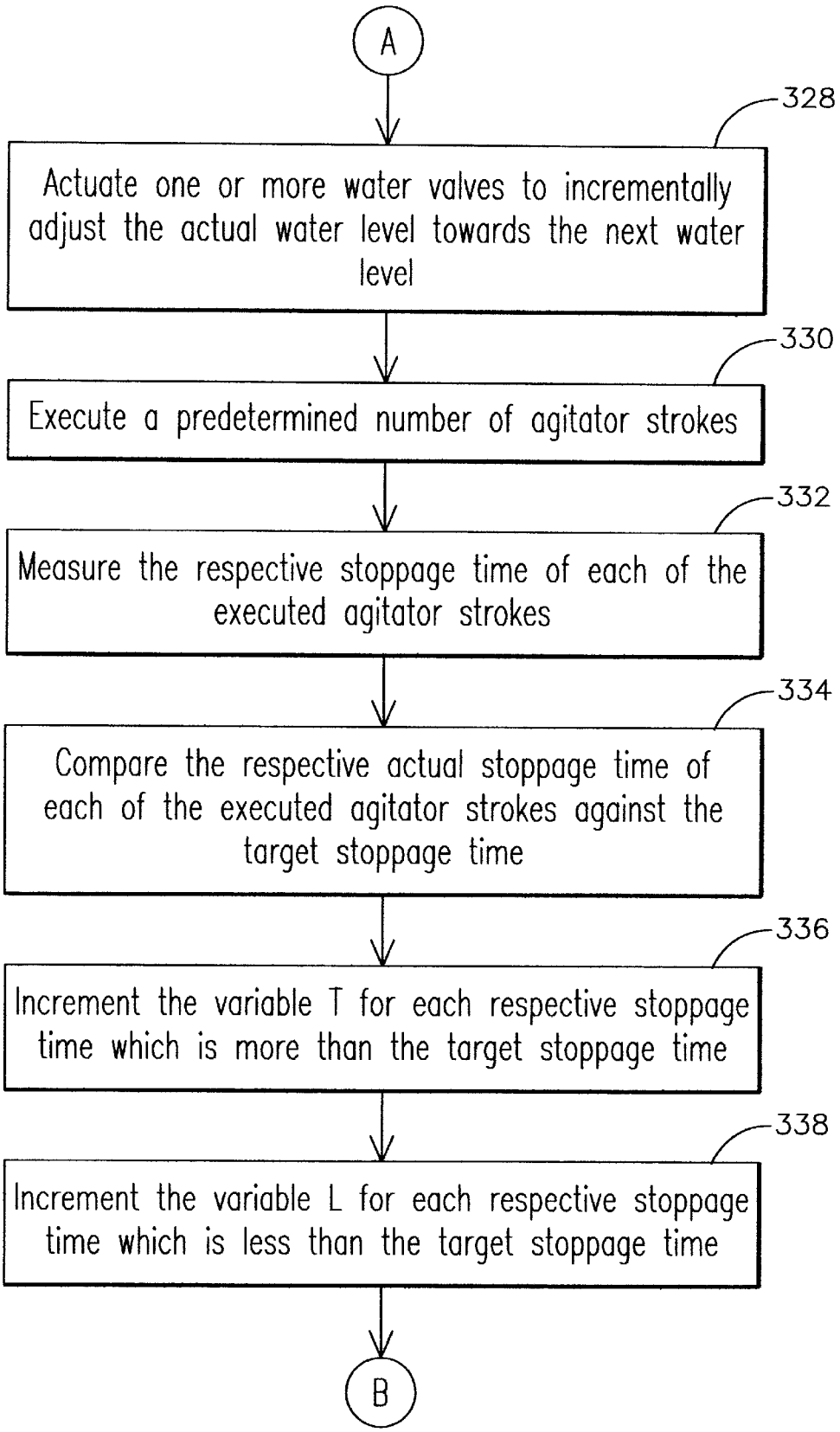
Figure 10C:
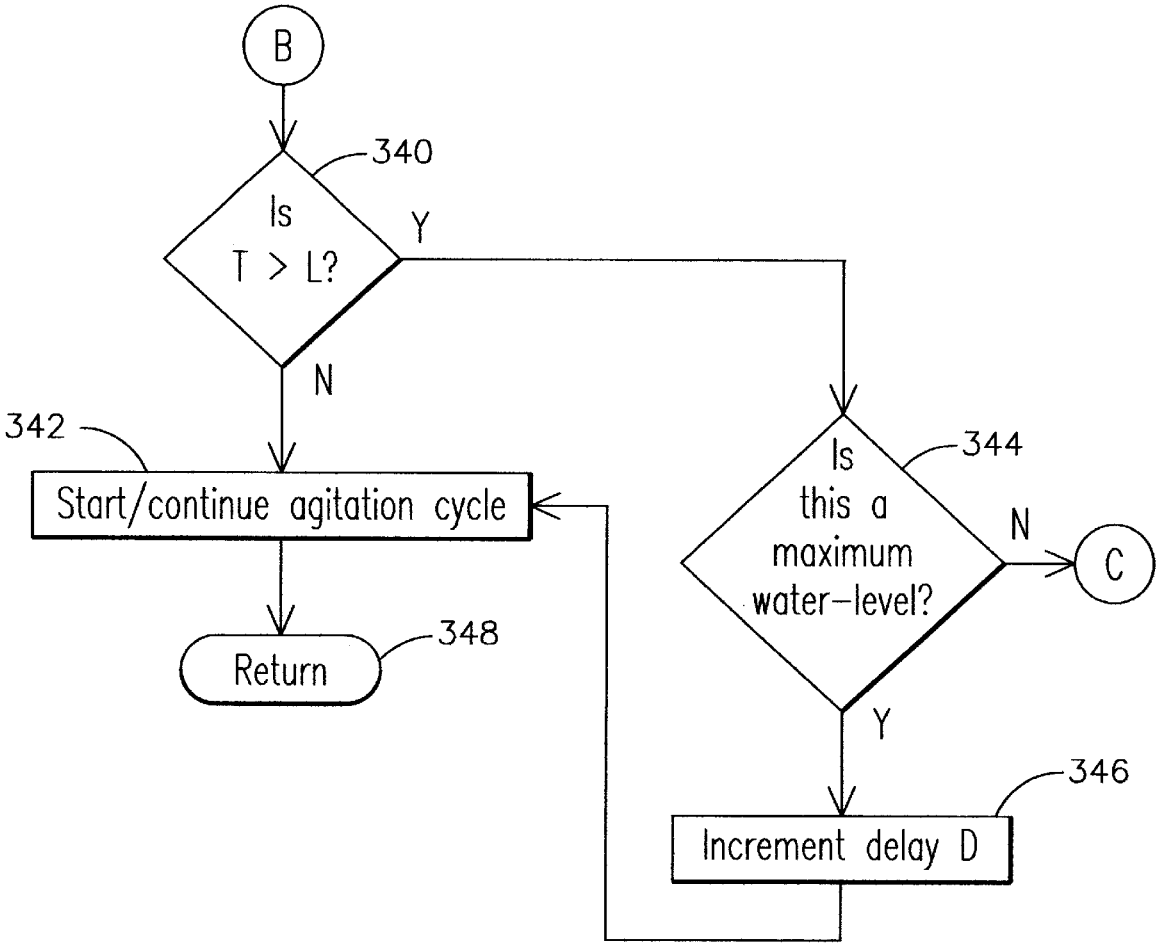
Figure 12D:
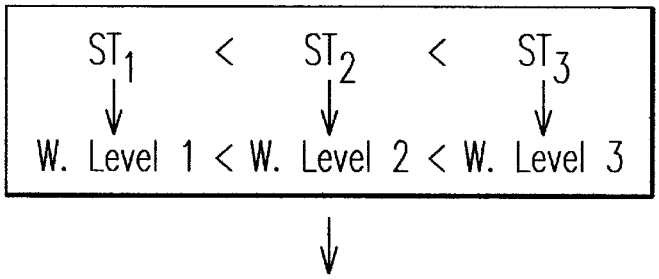
FIG. 12 shows exemplary plots illustrating in FIG. 12A an agitator inertial response as may occur when the actual water level is relatively low when compared to a desired water level for a given load; illustrating in FIG. 12B an agitator inertial response as may occur when the actual water level has been upwardly adjusted relative to the low water level of FIG. 12A; and further illustrating in FIG. 12C and FIG. 12D relative low and relatively long agitator stoppage times as compared to an intermediate optimum stoppage time for a given load, and wherein each of such stoppage times is associated with a respective water level.

FIG. 10 is a flow chart of an exemplary embodiment of the process 300 of the present invention. Subsequent to start step 318, step 320 allows for setting initial values of respective variables that determine whether the water valves are actuated to pass water. Block 322 shows exemplary variables that may be initialized in step 320, such as a counter variable (T) indicative of load tightness, a counter variable (L) indicative of load looseness, a variable ($V_f$) having a respective value indicative of a target final velocity of the agitator, a target agitator stoppage time and a variable (D) indicative of a delay value. Counter variables T and L may respectively indicate the presence of a relatively tight or loose load depending on whether the agitator stoppage time is higher or lower than a target stoppage time. As suggested above, step 324 allows for selecting a target agitator stoppage time based on the type of fabric to be washed. For example, if the user indicates that the load to be washed comprises delicate fabrics, then memory 80 in controller 70 (FIG. 5) would allow for retrieving a target stoppage time suitable for that type of fabric. Conversely, if the user indicates that the load to be washed comprises rugged fabrics, then the memory would allow for retrieving a different target stoppage time suitable for rugged fabrics. Step 326 allows for accumulating elapsed time indicative of the inertial response of the agitator, i.e., elapsed time upon the agitator being allowed to coast to reach the target final velocity $V_f$. Step 328, which is reached through connecting node A, allows for actuating the water valves to incrementally adjust the actual water level towards the next water level, so that upon execution of one or more iterations the target water level may be eventually reached as described below. Step 330 allows for executing a predetermined number of agitator strokes, e.g., a sufficiently high number of strokes, such as ten or more, so as to obtain a statistically meaningful indication as to whether the load density is relatively loose or tight. Step 332 allows for measuring the respective stoppage time of each of the executed agitator strokes. Step 334 allows for comparing the respective actual stoppage time of each of the executed agitator strokes against the target stoppage time. Step 336 allows for incrementing the value of the variable T for each respective stoppage time which is more than the value of the target stoppage time. Step 338 allows for incrementing the value of the variable L for each respective stoppage time which is less than the value of the target stoppage time.

Step 340, which is reached through connecting node B, allows for comparing the value of the variable T against the value of the variable L. If the value of the variable T is larger than the value of the variable L, then the process continues at step 344 that allows for determining whether the present water level is the maximum permissible water level in the washing machine. If step 344 determines that the present water level is not a maximum water level, then connecting node C allows for executing further iterations of the process 300 to further adjust the water level of the washing machine. If, on the other hand, step 344 determines that the present water level is in fact the maximum water level allowed in the washing machine, then step 346 allows for incrementing the value of the delay D so as to continue at step 342. It will be appreciated that step 346, allows for reducing the possibility of fabric damage since an increased delay D would result in less energy agitating energy being transferred to the load per stroke. Further, a suitable display message could be displayed so as to inform the operator, that the amount of load should be reduced. It will be appreciated that step 342 would allow for starting or continuing a respective agitation cycle of the washing machine prior to return step 348. Once an agitation cycle, e.g., a washing cycle, has started, process 300 may be executed at predetermined time intervals, e.g., every 30 seconds, so as to adapt the water level to varying load conditions, such as may occur if the user adds or removes articles from the washing machine, as the agitation cycle is progressing.

Figure 11A:
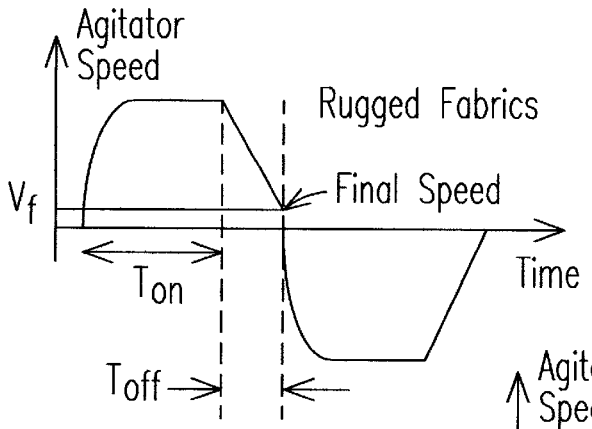
FIG. 11 shows exemplary plots illustrating in FIG. 11A an agitator motion pattern as may be desirable when the load to be washed comprises rugged fabrics requiring a relatively high number of strokes/min and/or angular travel/per stroke; and illustrating in FIG. 11B an agitator motion pattern as may be desirable when the load to be washed comprises delicate fabrics requiring a relatively low number of strokes/min and/or angular travel per/stroke.
Figure 11B:
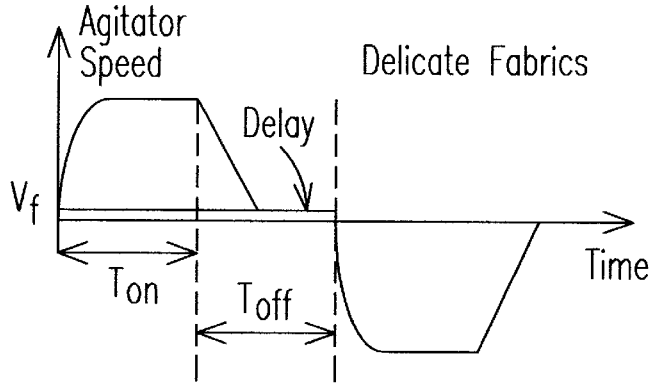

FIG. 11, made up of FIGS. 11A and 11B, shows exemplary plots that respectively plot agitator speed versus time for two distinct agitator motion patterns. As will be appreciated by those skilled in the art, the energy supplied to the load being washed on each stroke is usually proportional to the duty cycle of the motor control signals supplied to the motor drive, i.e., the percentage of time that the motor is energized per stroke. In a general case, it will be appreciated that the energy supplied to the load on each stroke may be generally characterized as a functional relationship of various operational parameters, such as amount of load, water level, %RUN, etc, where $\%RUN=T_{on}/(T_{on}+T_{off})$. Thus, by selectively controlling a respective agitator motion pattern, one is able to adaptively control the level of energy being imparted to the load to be washed based on the true needs of that load. By way of illustration of operation, the exemplary agitator motion pattern represented by the plot of FIG. 11A, may correspond to a washing condition where coarse or rugged fabrics are being washed. By way of comparison, the exemplary agitator motion pattern represented by the plot of FIG. 11B, may correspond to a washing condition where delicate fabrics are being washed.

Figure 12A:
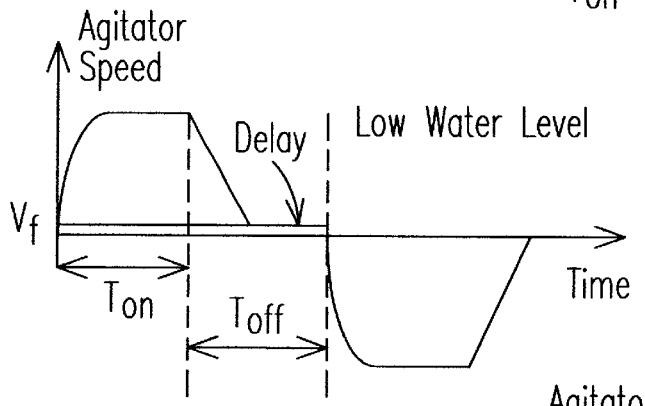
Figure 12B:
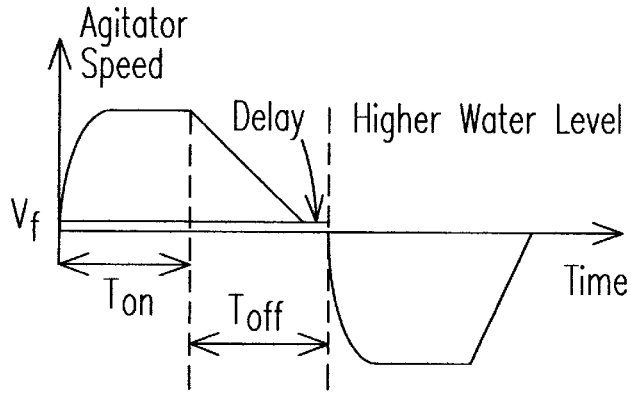
Figure 12C:
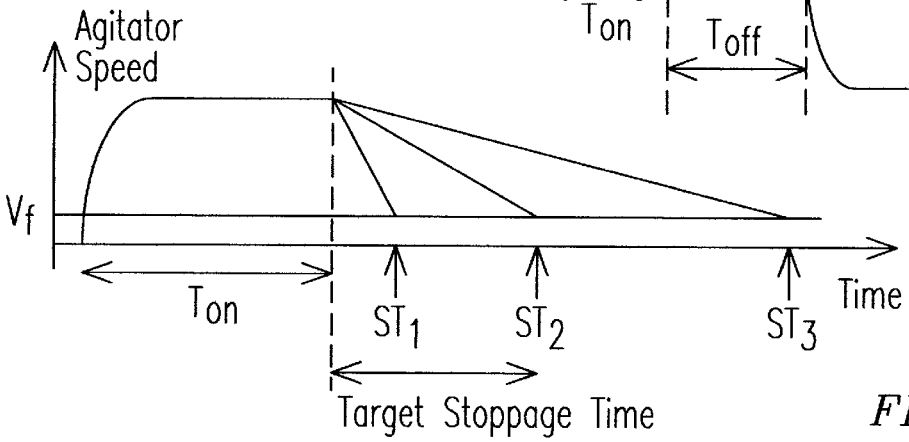

FIG. 12, made up of FIGS. 12A–12C, respectively illustrates exemplary plots such as may be generated when plotting agitator speed versus time as the water level of the washing machine is adaptively adjusted based on the process 300 described in the context of FIGS. 9 and 10. As shown in FIG. 12C, by way of example, $ST_2$ represents a target stoppage time for a given fabric and in particular $ST_2$ corresponds to an optimum target water level for that given fabric, e.g., water level two which is a water level intermediate between a water level one and a water level three that in turn would correspond to stoppage times, $ST_1$ and, $ST_3$ respectively. In this example, $ST_1$ would correspond to a stoppage time in a condition where water level one is well below water level two and even further below water level three and thus the stoppage time $ST_1$ would be relatively shorter as compared to respective stoppage times $ST_2$ and $ST_3$, as shown in FIG. 12D.

As shown in FIG. 12A, the exemplary plot therein would correspond to a washing condition where the actual water level is below the predetermined target water level for a given set of washing conditions, e.g., fabric type, intensity of wash, soil level, etc., and therefore based on the various steps described in the context of process 300, the water level would be incrementally adjusted to reach the predetermined target stoppage time. Conversely, as shown in FIG. 12B, the exemplary plot shown therein would correspond to a washing condition where the actual water level in the washing machine has been adaptively increased relative to the water level corresponding to the plot shown in FIG. 12A so as to substantially approach the target stoppage time.

Figure 13:
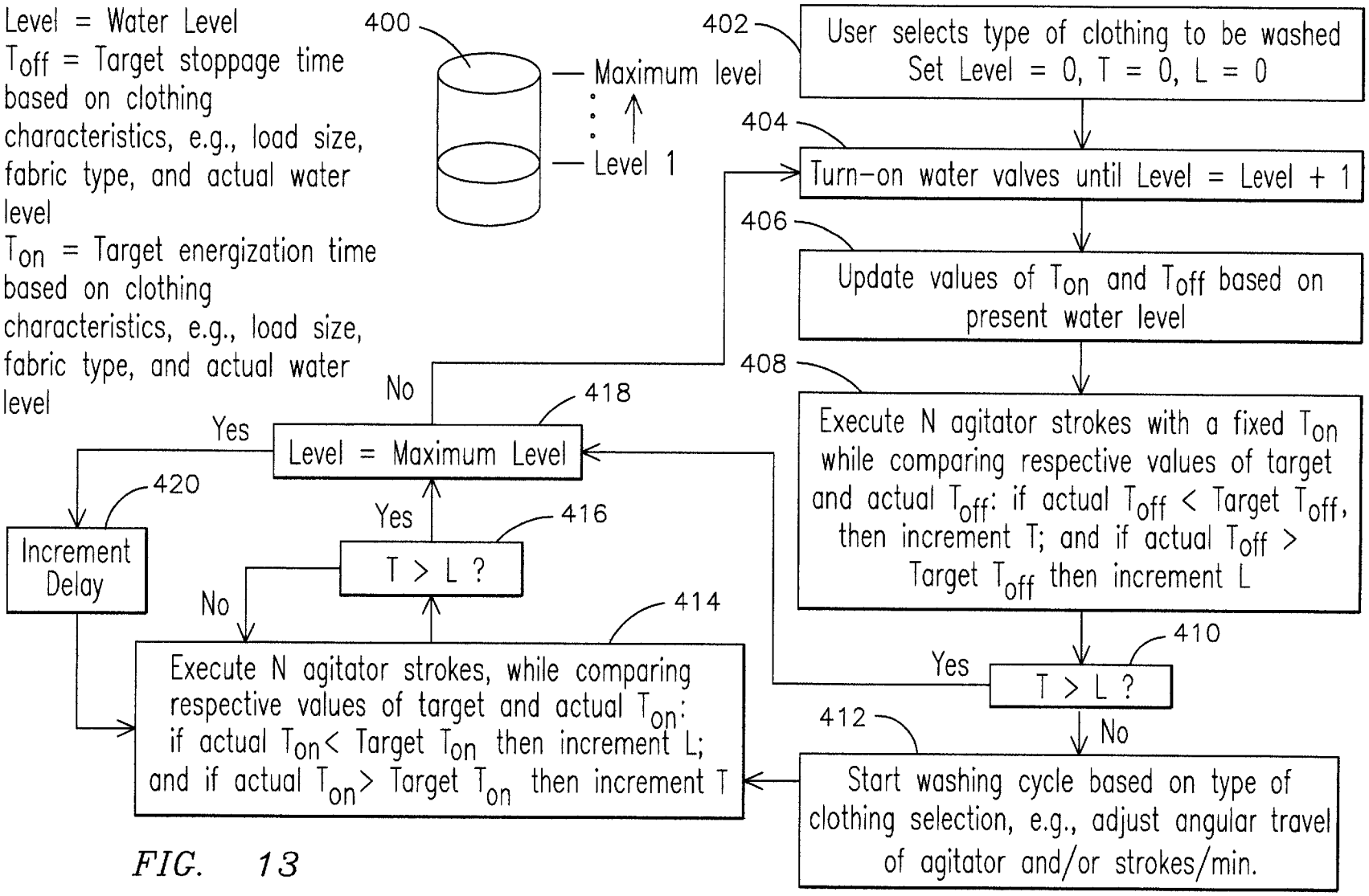
FIG. 13 is a flow chart of another exemplary embodiment of the process for controlling water level.

FIG. 13 shows a flow chart illustrating another exemplary embodiment of the process for controlling water level. As shown in FIG. 13, step 402 allows the user for selecting the type of clothing to be washed, such as heavy duty, delicate, etc. Step 402 further allows for initializing respective values of variables, such as water level, respective counters variables T and L that as suggested above may indicate the presence of a relatively tight or loose load depending on whether the agitator stoppage time is higher or lower than a target stoppage time for a respective water level. Step 404 allows for actuating one or more water valves to reach the next water level. As shown at selecting module 400, water level in the washing tub may be incremented from a minimum level to a maximum level based on various characteristics of the load, such as fabric type, load size, etc. Step 406 allows for setting respective values of variables $T_{off}$ and $T_{on}$. It will be appreciated that in the embodiment of FIG. 13, $T_{off}$ represents a target stoppage time selected as a function of clothing type and/or present water level, and $T_{on}$ represents a target motor energization time also selected as a function of clothing type and/or present water level.

Step 408 allows for executing a predetermined number of strokes (e.g., N strokes) with a fixed value of $T_{on}$, while comparing the respective values of target $T_{off}$, and actual $T_{off}$. By way of example, if the actual value of $T_{off}$ is less than the target value of $T_{off}$, then counter variable T may be incremented by one. Conversely, if the actual value of $T_{off}$ is more than the target value of $T_{off}$, then counter variable L may be incremented by one. As will be appreciated by those skilled in the art, the above technique allows for averaging over N strokes in order to determine whether the load is relatively tight or loose for a respective water level. For example, if counter variable T is higher than N/2 then this would indicate that the load density (lb/gal) is relatively low and additional water is likely to be required. Step 410 allows for comparing the respective values of counter variables T and L. If counter variable T has a value lower than the value of counter variable L, then step 412 allows for starting a respective washing cycle or rinse cycle wherein the agitator motion pattern may be adjusted to provide a desired angular travel and/or strokes/min. Step 414 allows for monitoring whether further adjustments to the water level may be needed as the washing cycle is being executed. More specifically, step 414 allows for executing N agitator strokes while comparing the respective values of target $T_{on}$ and actual $T_{on}$. By way of example, if the actual value of $T_{on}$ is less than the target value of $T_{on}$, then counter variable L is incremented. Conversely, if the actual value of $T_{on}$ is more than the target value of $T_{on}$, then counter variable T is incremented. Step 416 once again allows for comparing the respective values of counter variables T and L. If the result of respective comparing steps 410 and 416 is that the value of counter variable T is higher than counter variable L, then step 418 allows for determining whether the present water level is at the maximum realizable water level in the washing machine. If the answer is no, then the process will continue at step 404 to the next available water level. If the answer is yes, i.e., the present water level is at the maximum water level, then step 420 allows for incrementing a delay value following deenergization of the motor during execution of each stroke. If in comparing step 416, the result is that counter variable T is not higher than counter variable L, then the process iteratively continues at step 414 until either the washing cycle is terminated, or further adjustments are needed in the water level based on comparison step 416.

Figure 14:
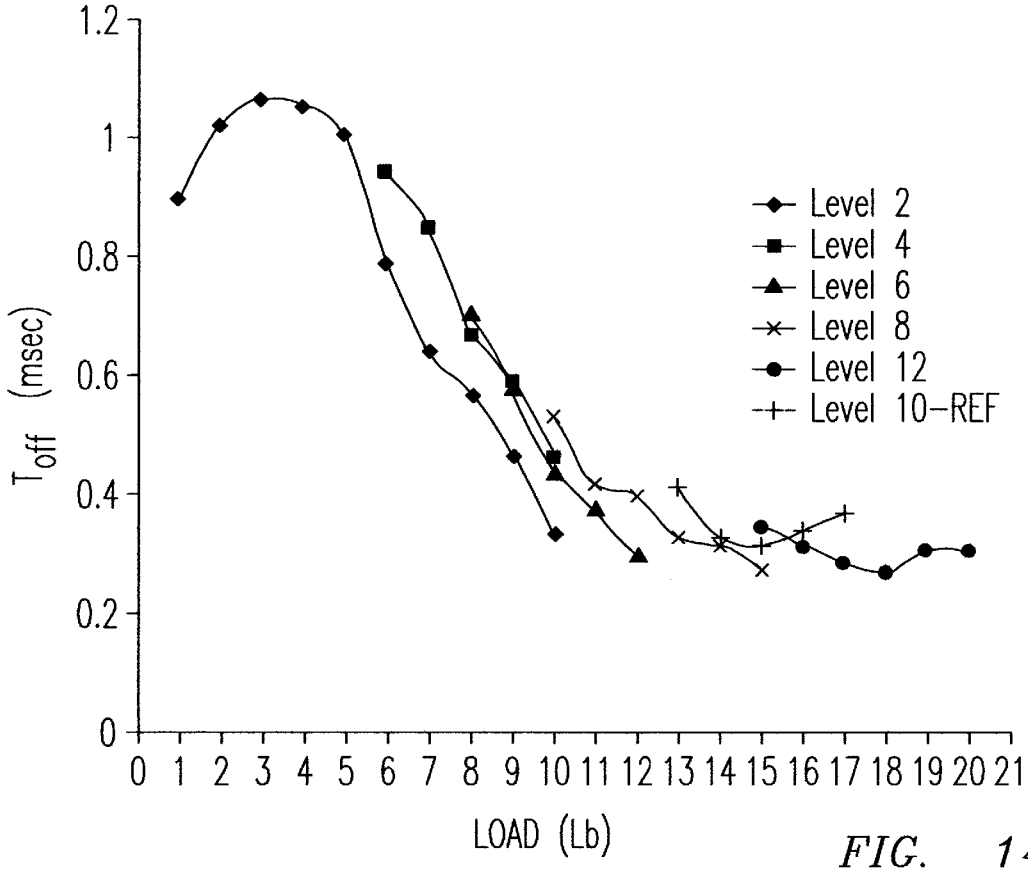
FIG. 14 shows an exemplary family of graphs respectively illustrating agitator stoppage time as a function of load size and water level, such as may be used in the flow chart of FIG. 13 for determining water level.

FIG. 14 shows a family or set of experimentally and/or analytically derived graphs each showing a respective relationship of agitator stoppage time as a function of load size and water level. It will be appreciated that additional graphs, similar to those shown in FIG. 14, may be obtained for various types of clothing and thus one may construct a multi-dimensional look-up table that stores $T_{off}$ as a function of load size, fabric-type and water level.

Figure 15:
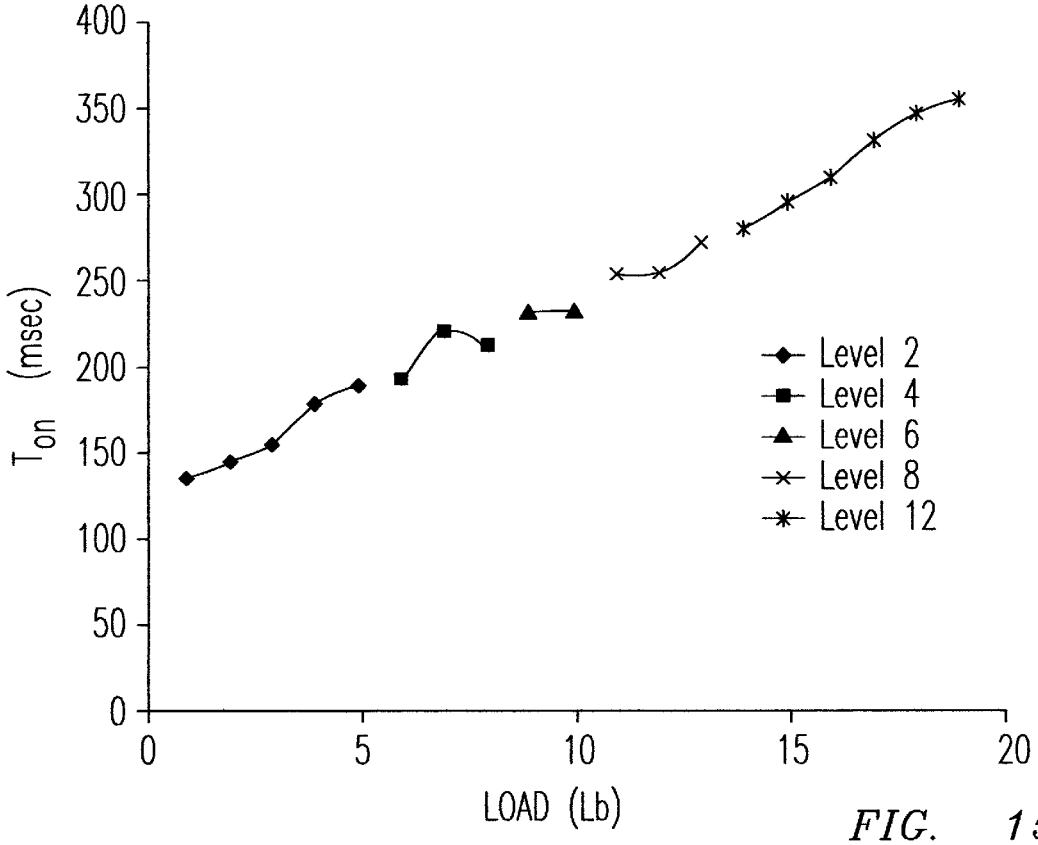
FIG. 15 shows an exemplary family of graphs respectively illustrating motor energization time as a function of load size and water level, such as may be used in the flow chart of FIG. 13 for determining water level.

FIG. 15 shows an exemplary family or set of graphs experimentally and/or analytically derived, each showing a respective relationship of motor energization time as a function of load size and water level. As suggested above, additional graphs, similar to those shown in FIG. 15, may be obtained for various types of clothing and thus one may construct a multi-dimensional look-up table that stores $T_{on}$ as a function of load size, fabric-type and water level. It is believed that the embodiment of FIG. 13 may provide a more accurate control of the water level based on being less susceptible to potential inaccuracies in the agitator stoppage time.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A process for controlling respective agitator motion patterns in a washing machine having a motor drive coupled to energize a motor that drives the agitator, the process comprising:

selecting a desired agitator motion pattern based on one or more pattern selection signals;

measuring one or more parameters indicative of the actual agitator motion pattern;

comparing the actual agitator motion pattern against the desired agitator motion pattern; and adjusting one or more control signals supplied to the motor drive for correcting deviations between the actual agitator motion pattern and the desired motion pattern.

2. The process of claim 1 wherein the selected agitator motion pattern comprises controlling angular travel of the agitator during each stroke of the agitator.

3. The process of claim 2 wherein the adjusting step comprises a step of setting initial values of respective variables that determine a respective agitator motion pattern.

4. The process of claim 3 further comprising a step of accumulating pulses indicative of agitator RPM and/or agitator travel upon start of each respective agitator stroke.

5. The process of claim 4 wherein the respective variables comprise a variable (X) having a respective value indicative of target pulses during a motor-on state, a variable (Y) having a respective value indicative of target pulses during a complete stroke, a variable ($V_f$) having a respective value indicative of a target final velocity of the agitator and a variable (D) indicative of a delay value.

6. The process of claim 5 further comprising a step of maintaining the motor-on state until the accumulated pulses reach the value of the X variable.

7. The process of claim 6 further comprising a step of maintaining a respective motor-off state until the agitator reaches the target final velocity, $V_f$.

8. The process of claim 7 further comprising a step of waiting in a dormant state for a period of time equal to the value of the delay D upon the agitator reaching the target final velocity, $V_f$.

9. The process of claim 8 further comprising a step of comparing pulses actually accumulated during the complete agitator stroke against the value of the Y variable.

10. The process of claim 9 further comprising a step of incrementing the value of the X variable depending on whether the value of the pulses actually accumulated during the complete agitator stroke is below the value of the Y variable.

11. The process of claim 10 further comprising a step of decrementing the value of the delay variable D by a predetermined amount.

12. The process of claim 11 further comprising iteratively executing the step for adjusting the one or more control signals supplied to the motor drive using the adjusted values of the respective variables X, Y, and D for each respective successive reciprocating stroke of the agitator at least until completion of an agitation time cycle of the washing machine.

13. The process of claim 9 further comprising a step of decrementing the value of the X variable depending on whether the value of the accumulated pulses is equal or above the value of the Y variable.

14. The process of claim 13 further comprising a step of computing number of strokes per unit of time by computing the inverse of elapsed time from start to finish of a respective stroke.

15. The process of claim 14 further comprising a step of comparing the computed value of number of strokes per unit of time against a target value of strokes per unit of time.

16. The process of claim 15 further comprising a step of incrementing the delay variable D by a predetermined amount when the computed value of strokes per unit of time exceeds the target value of strokes per minute.

17. The process of claim 16 further comprising iteratively executing the step for adjusting the one or more control signals supplied to the motor drive using the adjusted values of the respective variables X, Y, and D for each respective successive reciprocating stroke of the agitator at least until completion of an agitation time cycle of the washing machine.

18. The process of claim 15 further comprising a step of decrementing the delay variable D by a predetermined amount when the computed value of strokes per unit of time is below or at the target value of strokes per unit of time.

19. The process of claim 18 further comprising iteratively executing the step for adjusting the one or more control signals supplied to the motor drive using the adjusted values of the respective variables X, Y, and D for each respective successive reciprocating stroke of the agitator at least until completion of an agitation time cycle of the washing machine.

20. The process of claim 1 wherein the selected agitator motion pattern comprises controlling the number of strokes of the agitator per unit of time.

21. The process of claim 20 wherein the adjusting step comprises a step of setting initial values of respective variables that determine a respective agitator motion pattern.

22. The process of claim 21 further comprising a step of accumulating pulses indicative of agitator RPM upon start of each respective agitator stroke.

23. The process of claim 22 wherein the respective variables comprise a variable (X) having a respective value indicative of target pulses during a motor-on state, a variable (Y) having a respective value indicative of target pulses during a complete stroke, a variable ($V_f$) having a respective value indicative of a target final velocity of the agitator, and a variable (D) indicative of a delay value.

24. The process of claim 23 further comprising a step of maintaining the motor-on state until the accumulated pulses reach the value of the X variable.

25. The process of claim 24 further comprising a step of maintaining a respective motor-off state until the agitator reaches the target final velocity ($V_f$).

26. The process of claim 25 further comprising a step of waiting in a dormant state for a period of time equal to the value of the delay.

27. The process of claim 26 further comprising a step of computing number of strokes per unit of time by computing the inverse of elapsed time from start to finish of a respective stroke.

28. The process of claim 27 further comprising a step of comparing the computed value of number of strokes per unit of time against a target value of strokes per unit of time.

29. The process of claim 28 further comprising a step of decrementing the X variable if the computed value of number of strokes per unit of time is equal or less than the target value of strokes per unit of time.

30. The process of claim 29 further comprising iteratively executing the step for adjusting the one or more control signals supplied to the motor drive using the adjusted values of the respective variables X, Y, and,D for each respective successive reciprocating strokes of the agitator at least until completion of an agitation time cycle of the washing machine.

31. The process of claim 28 further comprising a step of comparing pulses actually accumulated during the complete agitator stroke against the value of the Y variable.

32. The process of claim 31 further comprising a step of incrementing the X variable if the value of the accumulated pulses is less than the Y variable.

33. The process of claim 32 further comprising a step of decrementing the delay variable D by a predetermined amount.

34. The process of claim 33 further comprising iteratively executing the step for adjusting the one or more control signals supplied to the motor drive using the adjusted values of the respective variables X, Y, and D for each respective successive reciprocating stroke of the agitator at least until completion of an agitation time cycle of the washing machine.

35. The process of claim 31 further comprising a step of incrementing the delay variable D by a predetermined amount if the value of the accumulated pulses is more than or equal than the Y variable.

36. The process of claim 35 further comprising iteratively executing the step for adjusting the one or more control signals supplied to the motor drive using the adjusted values of the respective variables X, Y, and D for each respective successive reciprocating strokes of the agitator at least until completion of an agitation time cycle of the washing machine.

37. The process of claim 1 wherein the selected motion pattern comprises controlling angular travel of the agitator during each stroke and/or the number of strokes of the agitator per unit of time.

38. The process of claim 1 wherein the pattern selection signals are programmed based on the type of fabric to be washed.

39. The process of claim 1 wherein the step of measuring one or more parameters indicative of the actual agitator motion pattern comprises counting the number of pulses from a sensor coupled to supply a stream of pulses indicative of agitator RPM and/or agitator travel.

40. The process of claim 39 wherein the sensor comprises a Hall-effect sensor.

41. The process of claim 1 further comprising a sub-process for automatically controlling water-level in the washing machine prior to and/or during execution of a respective agitation cycle.

42. The process of claim 41 wherein the sub-process for controlling water level comprises:

selecting a target water agitator inertial response indicative of a desired water level;

measuring a parameter indicative of the actual water level based on an actual inertial response of the agitator;

comparing the actual agitator inertial response against the target agitator inertial response; and selectively actuating one or more water valves for allowing passage of water so as to adjust the water level of the washing machine based on deviations between the actual agitator inertial response and the target agitator inertial response.

43. The process of claim 42 further comprising a step of generating a timer signal indicative of the inertial response of the agitator.

44. The process of claim 43 further comprising a step of setting initial values of respective variables for controlling the water level.

45. The process of claim 44 wherein the respective variables comprises a variable (T) having a respective value indicative of load tightness, a variable (L) having a respective value indicative of load looseness, a variable ($V_f$) having a respective value indicative of a target final velocity of the agitator, a target agitator stoppage time, and a variable (D) indicative of a delay value.

46. The process of claim 45 wherein the target agitator stoppage time is selected based on the type of fabric to be washed.

47. The process of claim 45 wherein the parameter indicative of water level based on the inertia response of the agitator comprises a respective actual agitator stoppage time upon the motor drive being deenergized up to the agitator reaching the target final velocity.

48. The process of claim 47 further comprising a step of actuating the one or more water valves to incrementally increase the actual water level towards a next available water level.

49. The process of claim 48 further comprising executing a predetermined number of agitator strokes to measure the respective actual stoppage time of each of the executed agitator strokes.

50. The process of claim 49 further comprising a step of comparing the respective actual stoppage time of each of the executed agitator strokes against the target stoppage time.

51. The process of claim 50 further comprising a step of incrementing the variable T if the actual stoppage time is more than the target stoppage time.

52. The process of claim 51 further comprising a step of incrementing the variable L if the stoppage time is less than the target stoppage time.

53. The process of claim 52 further comprising a step of comparing the value of the T variable against the value of the L variable.

54. The process of claim 53 further comprising a step of continuing the respective agitation cycle if the value of the L variable is larger than the value of the T variable.

55. The process of claim 54 further comprising a step of determining whether the actual water level is the highest water level allowed.

56. The process of claim 55 further comprising a step of incrementing the value of the delay variable D prior to returning to the agitation cycle.

57. The process of claim 48 further comprising a step of executing further iterations of the water valves actuating step and subsequent steps of the sub-process for controlling water level so as to reach the target water level.

58. A control system for controlling respective agitator motion patterns in a washing machine having a motor drive coupled to energize a motor that drives the agitator, the system comprising:

a selecting module configured to select a desired agitator motion pattern based on one or more pattern selection signals;

a measuring module configured to measure one or more parameters indicative of the actual agitator motion pattern;

a comparing module configured to compare the actual agitator motion pattern against the desired agitator motion pattern; and an adjusting module configured to adjust one or more control signals supplied to the motor drive for correcting deviations between the actual agitator motion pattern and the desired motion pattern.

59. The system of claim 58 wherein the selected agitator motion pattern comprises controlling angular travel of the agitator during each stroke of the agitator.

60. The system of claim 59 wherein the adjusting module includes an initialization submodule configured to set initial values of respective variables that determine a respective duty cycle of the one or more control signals applied to the motor drive.

61. The system of claim 60 further comprising an accumulator configured to accumulate pulses indicative of agitator RPM and/or agitator travel upon start of each respective agitator stroke.

62. The system of claim 61 wherein the respective variables comprise a variable (X) having a respective value indicative of target pulses during a motor-on state, a variable (Y) having a respective value indicative of target pulses during a complete stroke, a variable ($V_f$) having a respective value indicative of a target final velocity of the agitator and a variable (D) indicative of a delay value.

63. The system of claim 62 further comprising means for maintaining the motor-on state until the accumulated pulses reach the value of the X variable.

64. The system of claim 63 further comprising means for maintaining a respective motor-off state until starting another agitator stroke.

65. The system of claim 64 further comprising means for waiting in a dormant state for a period of time equal to the value of the delay D upon the agitator reaching the target final velocity, $V_f$.

66. The system of claim 65 further comprising means for comparing pulses actually accumulated during the complete agitator stroke against the value of the Y variable.

67. The system of claim 66 further comprising means for incrementing the value of the X variable depending on whether the value of the pulses actually accumulated during the complete agitator stroke is below the value of the Y variable.

68. The system of claim 67 further comprising means for decrementing the value of the delay variable D by a predetermined amount.

69. The system of claim 68 further comprising iteratively executing the step for adjusting the one or more control signals supplied to the motor drive using the adjusted values of the respective variables X, Y, and D for each respective successive reciprocating stroke of the agitator at least until completion of an agitation time cycle of the washing machine.

70. The system of claim 66 further comprising means for decrementing the value of the X variable depending on whether the value of the accumulated pulses is equal or above the value of the Y variable.

71. The system of claim 70 further means for computing number of strokes per unit of time by computing the inverse of elapsed time from start to finish of a respective stroke.

72. The system of claim 71 further comprising means for comparing the computed value of number of strokes per unit of time against a target value of strokes per unit of time.

73. The system of claim 72 further comprising means for incrementing the delay variable D by a predetermined amount when the computed value of strokes per unit of time exceeds the target value of strokes per minute.

74. The system of claim 73 further comprising iteratively executing the step for adjusting the one or more control signals supplied to the motor drive using the adjusted values of the respective variables X, Y, and D for each respective successive reciprocating stroke of the agitator at least until completion of an agitation time cycle of the washing machine.

75. The system of claim 72 further comprising means for decrementing the delay variable D by a predetermined amount when the computed value of strokes per unit of time is below or at the target value of strokes per unit of time.

76. The system of claim 75 further comprising means for iteratively executing the step for adjusting the one or more control signals supplied to the motor drive using the adjusted values of the respective variables X, Y, and D for each respective successive reciprocating stroke of the agitator at least until completion of an agitation time cycle of the washing machine.

77. The system of claim 58 wherein the selected agitator motion pattern comprises controlling the number of strokes of the agitator per unit of time.

78. The system of claim 77 wherein the adjusting module comprises an initializing submodule configured to set initial values of respective variables that determine a respective duty cycle of one or more of the control signals applied to the motor drive.

79. The system of claim 78 further comprising an accumulator configured to accumulate pulses indicative of agitator RPM and/or agitator travel upon start of each respective agitator stroke.

80. The system of claim 79 wherein the respective variables comprise a variable (X) having a respective value indicative of target pulses during a motor-on state, a variable (Y) having a respective value indicative of target pulses during a complete stroke, a variable ($V_f$) having a respective value indicative of a target final velocity of the agitator, and a variable (D) indicative of a delay value.

81. The system of claim 80 further comprising means for maintaining the motor-on state until the accumulated pulses reach the value of the X variable.

82. The system of claim 81 further comprising means for maintaining a respective motor-off state until starting another agitator stroke.

83. The system of claim 82 further comprising means for waiting in a dormant state for a period of time equal to the value of the delay upon the agitator reaching the target final velocity ($V_f$).

84. The system of claim 83 further comprising means for computing number of strokes per unit of time by computing the inverse of elapsed time from start to finish of a respective stroke.

85. The system of claim 84 further comprising means for comparing the computed value of number of strokes per unit of time against a target value of strokes per unit of time.

86. The system of claim 85 further comprising means for decrementing the X variable if the computed value of number of strokes per unit of time is equal or less than the target value of strokes per unit of time.

87. The system of claim 86 further comprising means for iteratively executing the step for adjusting the one or more control signals supplied to the motor drive using the adjusted values of the respective variables X, Y, and D for each respective successive reciprocating strokes of the agitator at least until completion of an agitation time cycle of the washing machine.

88. The system of claim 85 further comprising means for comparing pulses actually accumulated during the complete agitator stroke against the value of the Y variable.

89. The system of claim 88 further comprising means for incrementing the X variable if the value of the accumulated pulses is less than the Y variable.

90. The system of claim 89 further comprising means for decrementing the delay variable D by a predetermined amount.

91. The system of claim 90 further comprising means for iteratively executing the step for adjusting the one or more control signals supplied to the motor drive using the adjusted values of the respective variables X, Y, and D for each respective successive reciprocating stroke of the agitator at least until completion of an agitation time cycle of the washing machine.

92. The system of claim 88 further comprising means for incrementing the delay variable D by a predetermined amount if the value of the accumulated pulses is more than or equal than the Y variable.

93. The system of claim 92 further comprising means for iteratively executing the step for adjusting the one or more control signals supplied to the motor drive using the adjusted values of the respective variables X, Y, and D for each respective successive reciprocating strokes of the agitator at least until completion of an agitation time cycle of the washing machine.

94. The system of claim 58 wherein the selected motion pattern comprises controlling angular travel of the agitator during each stroke and/or the number of strokes of the agitator per unit of time.

95. The system of claim 58 wherein the pattern selection signals are programmed based on the type of fabric to be washed.

96. The system of claim 58 wherein the measuring module is further configured to count pulses from a sensor coupled to supply a stream of pulses indicative of agitator RPM and/or agitator travel.

97. The system of claim 96 wherein the sensor comprises a Hall-effect sensor.

98. A washing machine programmed for selectively controlling agitator motion patterns, the washing machine comprising:

a motor that drives the agitator;

a motor drive coupled to energize the motor; and a controller coupled to supply one or more control signals to the motor drive, the controller in turn comprising:

a selecting module configured to select a desired agitator motion pattern based on one or more pattern selection signals;

a measuring module configured to measure one or more parameters indicative of the actual agitator motion pattern;

a comparing module configured to compare the actual agitator motion pattern against the desired agitator motion pattern; and an adjusting module configured to adjust the one or more control signals supplied to the motor drive for correcting deviations between the actual agitator motion pattern and the desired motion pattern.

99. The washing machine of claim 98 wherein the selected agitator motion pattern comprises controlling angular travel of the agitator during each stroke of the agitator.

100. The washing machine of claim 99 wherein the adjusting module includes an initialization submodule configured to set initial values of respective variables that determine a respective duty cycle of the one or more control signals applied to the motor drive.

101. The washing machine of claim 100 further comprising an accumulator configured to accumulate pulses indicative of agitator RPM and/or agitator travel upon start of each respective agitator stroke.

102. The washing machine of claim 101 wherein the respective variables comprise a variable (X) having a respective value indicative of target pulses during a motor-on state, a variable (Y) having a respective value indicative of target pulses during a complete stroke, a variable ($V_f$) having a respective value indicative of a target final velocity of the agitator and a variable (D) indicative of a delay value.

103. The washing machine of claim 102 further comprising means for maintaining the motor-on state until the accumulated pulses reach the value of the X variable.

104. The washing machine of claim 103 further comprising means for maintaining a respective motor-off state until starting another agitator stroke.

105. The washing machine of claim 104 further comprising means for waiting in a dormant state for a period of time equal to the value of the delay D upon the agitator reaching the target final velocity, $V_f$.

106. The washing machine of claim 105 further comprising means for comparing pulses actually accumulated during the complete agitator stroke against the value of the Y variable.

107. The washing machine of claim 106 further comprising means for incrementing the value of the X variable depending on whether the value of the pulses actually accumulated during the complete agitator stroke is below the value of the Y variable.

108. The washing machine of claim 107 further comprising means for decrementing the value of the delay variable D by a predetermined amount.

109. The washing machine of claim 108 further comprising iteratively executing the step for adjusting the one or more control signals supplied to the motor drive using the adjusted values of the respective variables X, Y, and D for each respective successive reciprocating stroke of the agitator at least until completion of an agitation time cycle of the washing machine.

110. The washing machine of claim 106 further comprising means for decrementing the value of the X variable depending on whether the value of the accumulated pulses is equal or above the value of the Y variable.

111. The washing machine of claim 110 further means for computing number of strokes per unit of time by computing the inverse of elapsed time from start to finish of a respective stroke.

112. The washing machine of claim 111 further comprising means for comparing the computed value of number of strokes per unit of time against a target value of strokes per unit of time.

113. The washing machine of claim 112 further comprising means for incrementing the delay variable D by a predetermined amount when the computed value of strokes per unit of time exceeds the target value of strokes per minute.

114. The washing machine of claim 113 further comprising iteratively executing the step for adjusting the one or more control signals supplied to the motor drive using the adjusted values of the respective variables X, Y, and D for each respective successive reciprocating stroke of the agitator at least until completion of an agitation time cycle of the washing machine.

115. The washing machine of claim 112 further comprising means for decrementing the delay variable D by a predetermined amount when the computed value of strokes per unit of time is below or at the target value of strokes per unit of time.

116. The washing machine of claim 115 further comprising means for iteratively executing the step for adjusting the one or more control signals supplied to the motor drive using the adjusted values of the respective variables X, Y, and D for each respective successive reciprocating stroke of the agitator at least until completion of an agitation time cycle of the washing machine.

117. The washing machine of claim 98 wherein the selected agitator motion pattern comprises controlling the number of strokes of the agitator per unit of time.

118. The washing machine of claim 117 wherein the adjusting module comprises an initializing submodule configured to set initial values of respective variables that determine a respective duty cycle of one or more of the control signals applied to the motor drive.

119. The washing machine of claim 118 further comprising an accumulator configured to accumulate pulses indicative of agitator RPM and/or agitator travel upon start of each respective agitator stroke.

120. The washing machine of claim 119 wherein the respective variables comprise a variable (X) having a respective value indicative of target pulses during a motor-on state, a variable (Y) having a respective value indicative of target pulses during a complete stroke, a variable ($V_f$) having a respective value indicative of a target final velocity of the agitator, and a variable (D) indicative of a delay value.

121. The washing machine of claim 120 further comprising means for maintaining the motor-on state until the accumulated pulses reach the value of the X variable.

122. The washing machine of claim 121 further comprising means for maintaining a respective motor-off state until the agitator reaches the target final velocity ($V_f$).

123. The washing machine of claim 122 further comprising means for waiting in a dormant state for a period of time equal to the value of the delay upon the agitator reaching the target final velocity ($V_f$).

124. The washing machine of claim 123 further comprising means for computing number of strokes per unit of time by computing the inverse of elapsed time from start to finish of a respective stroke.

125. The washing machine of claim 124 further comprising means for comparing the computed value of number of strokes per unit of time against a target value of strokes per unit of time.

126. The washing machine of claim 125 further comprising means for decrementing the X variable if the computed value of number of strokes per unit of time is equal or less than the target value of strokes per unit of time.

127. The washing machine of claim 126 further comprising means for iteratively executing the step for adjusting the one or more control signals supplied to the motor drive using the adjusted values of the respective variables X, Y, and D for each respective successive reciprocating strokes of the agitator at least until completion of an agitation time cycle of the washing machine.

128. The washing machine of claim 125 further comprising means for comparing pulses actually accumulated during the complete agitator stroke against the value of the Y variable.

129. The system of claim 128 further comprising means for incrementing the X variable if the value of the accumulated pulses is less than the Y variable.

130. The washing machine of claim 129 further comprising means for decrementing the delay variable D by a predetermined amount.

131. The washing machine of claim 130 further comprising means for iteratively executing the step for adjusting the one or more control signals supplied to the motor drive using the adjusted values of the respective variables X, Y, and D for each respective successive reciprocating stroke of the agitator at least until completion of an agitation time cycle of the washing machine.

132. The washing machine of claim 128 further comprising means for incrementing the delay variable D by a predetermined amount if the value of the accumulated pulses is more than or equal than the Y variable.

133. The washing machine of claim 132 further comprising means for iteratively executing the step for adjusting the one or more control signals supplied to the motor drive using the adjusted values of the respective variables X, Y, and D for each respective successive reciprocating strokes of the agitator at least until completion of an agitation time cycle of the washing machine.

134. The washing machine of claim 98 wherein the selected motion pattern comprises controlling angular travel of the agitator during each stroke and/or the number of strokes of the agitator per unit of time.

135. The washing machine of claim 98 wherein the pattern selection signals are programmed based on the type of fabric to be washed.

136. The washing machine of claim 98 wherein the measuring module is further configured to count pulses from a sensor coupled to supply a stream of pulses indicative of agitator RPM and/or agitator travel.

137. The washing machine of claim 136 wherein the sensor comprises a Hall-effect sensor.

* * * * *